US005313010A

United States Patent [19]

Matsushima et al.

[11] Patent Number: 5,313,010

[45] Date of Patent: May 17, 1994

[54] HAND MUSICAL TONE CONTROL APPARATUS

[75] Inventors: Shunichi Matsushima; Masao Sakama; Hideo Suzuki; Masahiko Obata; Takamichi Masabuchi, all of Hamamatsu, Japan

[73] Assignee: Yamaha Corporation, Hamamatsu, Japan

[21] Appl. No.: 971,674

[22] Filed: Nov. 4, 1992

Related U.S. Application Data

[63] Continuation of Ser. No. 454,058, Dec. 20, 1989, abandoned.

[30] Foreign Application Priority Data

Dec. 27, 1988 [JP] Japan ..... 63-329698
Mar. 1, 1989 [JP] Japan ..... 1-49279

[51] Int. Cl.[5] ..... G10H 7/00

[52] U.S. Cl. ..... 84/600; 84/644; 84/743

[58] Field of Search ..... 84/600, 644, 670, 718, 84/743; 338/64, 68, 178

[56] References Cited

U.S. PATENT DOCUMENTS

| | | | |
|---|---|---|---|
| 3,165,713 | 1/1965 | Mounteer | 338/68 |
| 3,700,836 | 10/1972 | Rackson | 200/52 R |
| 3,795,882 | 3/1974 | Tokubo | 338/128 |
| 4,216,467 | 8/1980 | Colston | 340/177 R |
| 4,245,539 | 1/1981 | Jones . | |
| 4,481,854 | 11/1984 | Dugas | 84/736 |
| 4,794,838 | 1/1989 | Corrigau, III | 84/600 |
| 4,905,560 | 3/1990 | Suzuki et al. | 84/600 |
| 4,962,688 | 10/1990 | Suzuki et al. | 84/600 |
| 4,977,811 | 12/1990 | Suzuki et al. | 84/600 |
| 4,998,457 | 3/1991 | Suzuki et al. | 84/600 |
| 5,105,708 | 4/1992 | Suzuki et al. | 84/600 |
| 5,125,313 | 6/1992 | Hiyoshi et al. | 84/600 |
| 5,127,301 | 7/1992 | Suzuki et al. | 84/600 |
| 5,170,002 | 12/1992 | Suzuki et al. | 84/600 |
| 5,177,311 | 1/1993 | Suzuki et al. | 84/600 |
| 5,192,823 | 3/1993 | Suzuki et al. | 84/600 |

FOREIGN PATENT DOCUMENTS

| | | | |
|---|---|---|---|
| 0110147 | 6/1984 | European Pat. Off. | 338/68 |
| 2224061 | 10/1974 | France . | |
| 55-68192 | 5/1980 | Japan . | |
| 56-3590 | 1/1981 | Japan . | |
| 58-142422 | 8/1983 | Japan | 341/20 |
| 61-196297 | 12/1986 | Japan . | |

OTHER PUBLICATIONS

Kennedy, IBM Technical Disclosure Bulletin, Apr. 1984, pp. 5826–5827, vol. 26, No. 11.

Published European Patent Application No. 264,782 to Hiyoshi.

*Primary Examiner*—William M. Shoop, Jr.
*Assistant Examiner*—Jeffrey W. Donels
*Attorney, Agent, or Firm*—Graham & James

[57] ABSTRACT

A musical tone control apparatus has grips and elbow angle detectors, in which the grips are hand held and provided with push-button switches and an actuator, both of which are operated by fingers to generate musical tone control data having variations of musical tone. While the elbow angle detectors are provided with an angle detector for measuring an angle of the elbow during a performance, and generating musical tone control data with the variations corresponding to the angle of the elbow. Each variation is determined by function assignments which correspond to each of the fingers and elbows. The function assignments are preloaded in a memory device, such as a depth of vibrato, a speed of tremolo, a range of pitch-bend, and the like. Accordingly, the musical tone control apparatus transfers musical tone control data having variations to a musical tone generating apparatus to produce a musical tone from a speaker.

19 Claims, 22 Drawing Sheets

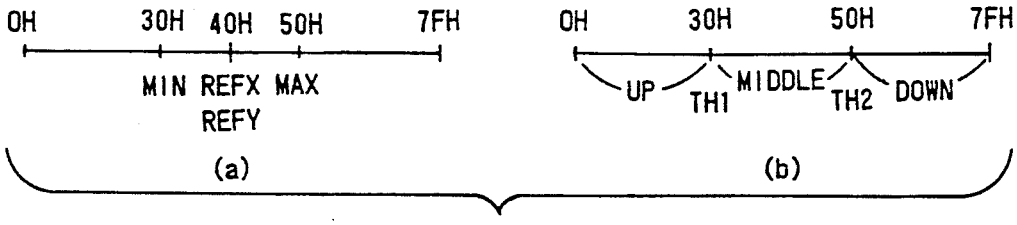
FIG. 15
| RIGHT ARM DIRECTION | FUNCTION |
|---|---|
| UP | ONE OCTAVE HIGH |
| MIDDLE | — |
| DOWN | ONE OCTAVE LOW |
FIG. 13
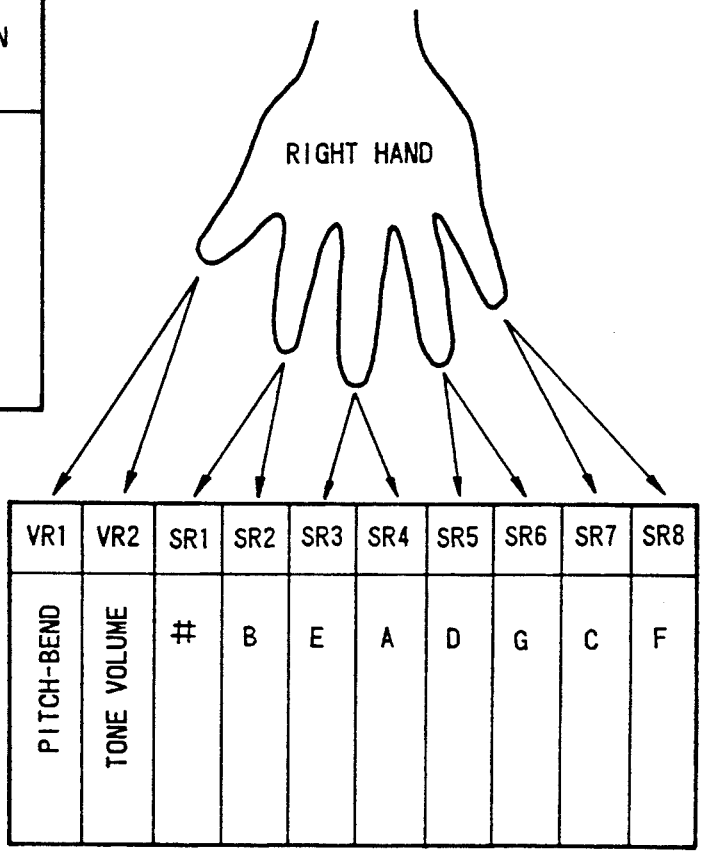
FIG. 12

(a)

(b)

| ARMS DIRECTION | | TONE | TONE |
|---|---|---|---|
| LEFT | RIGHT | PITCH1 | PITCH2 |
| UP | UP | C | C |
| UP | MIDDLE | D | D |
| UP | DOWN | E | E |
| MIDDLE | UP | E | F |
| MIDDLE | MIDDLE | F | G |
| MIDDLE | DOWN | G | A |
| DOWN | UP | G | B |
| DOWN | MIDDLE | A | $C^+$ |
| DOWN | DOWN | B | $D^+$ |

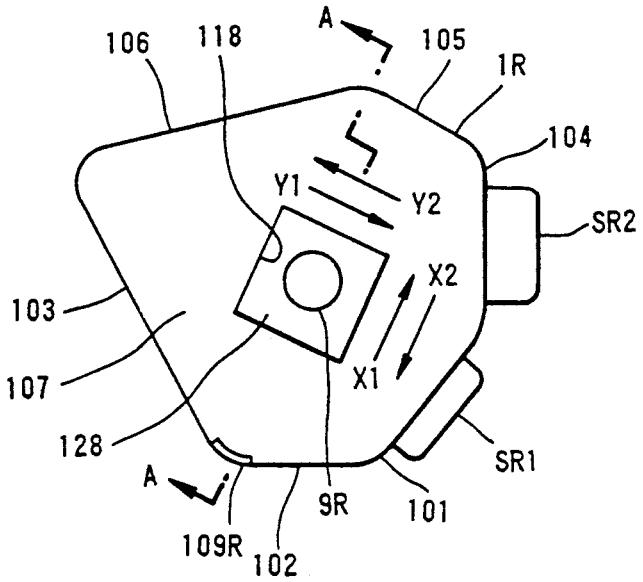
FIG.23
FIG.24(c)
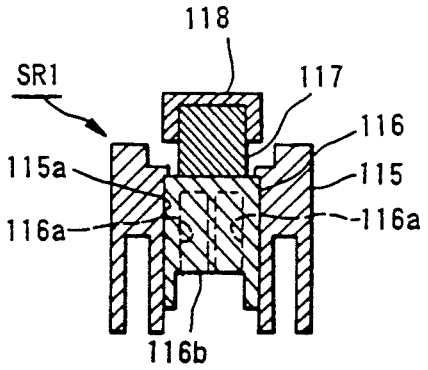
FIG.24(b)
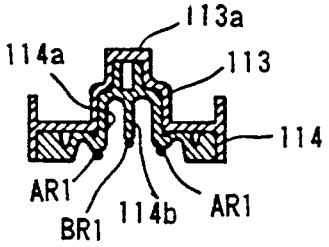
FIG.24(a)
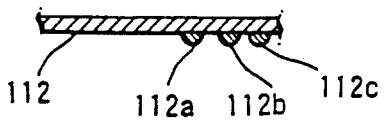

HAND MUSICAL TONE CONTROL APPARATUS

This is a continuation of copending application Ser. No. 07/454,058 filed on Dec. 20, 1989 now abandoned.

FIELD OF THE INVENTION

The present invention relates to a musical tone control apparatus capable of controlling musical tone corresponding to movement of a player's hand or fingers.

PRIOR ART

Conventional musical tone control apparatus is disclosed in the Japanese Utility-model Application No. 61-196297. This musical tone control apparatus comprises a holding portion held by a hand of a player; key-switches operated by fingers of a player; and an attaching belt for holding a main instrument connected to the holding instrument. Accordingly, turning a key-switch on produces a musical tone having a predetermined tone pitch corresponding to the key-switch.

Other musical tone control apparatuses are disclosed in the Japanese Utility-model Application Nos. 55-68192 and 56-3590. An input device of the musical tone control apparatuses comprises a stick movable in all directions in a plane; rotation type of variable resistors movable in a rotating direction; and a conversion mechanism for transferring movement of the stick to variable resistors by converting that movement into a rotating movement. Accordingly moving the stick changes a resistance value of respective rotary type variable resistors.

However, these conventional musical tone control apparatuses have disadvantages in that high quality performance cannot be achieved such as one with a musical tone including variations, such as, a so-called pitch-bend and modulation. The apparatuses simply produce musical tones having tone pitches corresponding to each key-switch. In addition, the conventional musical tone control apparatus has disadvantages in that it is complicated in construction and relatively large in size.

SUMMARY OF THE INVENTION

It is accordingly an object of the present invention to provide a musical tone control apparatus capable of achieving a high quality performance, such as one with a musical tone including variations of a pitch-bend, a tremolo, a vibrato, and the like.

It is another object of the present invention to provide a musical tone control apparatus which is constructed with a compact shape.

In an aspect of the present invention, there is provided a musical tone control apparatus for controlling musical tone corresponding to movement of parts of a human body, comprising: a holding member held by a part of the human body; operating member moved by the part of the human body, the operating member being arranged on the holding member; a conversion device for converting a movement of the operating member into a signal corresponding to a magnitude of the movement; and a control data generating device for generating musical tone control data corresponding to the signal so that the musical tone control data is output to a musical tone generating apparatus, in which the musical tone control data includes variations of a musical tone determined by given function assignments.

Accordingly, musical tone control data includes the variations of musical tone determined by the given function assignments such as a range of pitch-bend, a depth of vibrato, a speed of tremolo, and the like, so that a high performance can be carried out by the musical tone generating apparatus by receiving such musical tone control data from the musical tone control apparatus. Furthermore, the conversion means, such as rotary type variable resistors and slide variable resistors, is incorporated in the holding member as of a unit, so that the holding member can be constructed in a compact shape.

BRIEF DESCRIPTION OF THE DRAWINGS

FIGS. 12 and 13 are diagrams showing a function assignments of grip 1R and elbow angle detector 30R;

FIGS. 15(*a*) and 15(*b*) are diagrams describing an initiation routine (step S1) of a main routine;

FIG. 23 is a plan view showing grip 1R;

FIGS. 24(*a*) to 24(*c*) are section views showing a construction of push-button switch SR1;

DESCRIPTION OF THE PREFERRED EMBODIMENTS

Figures 1, 4:
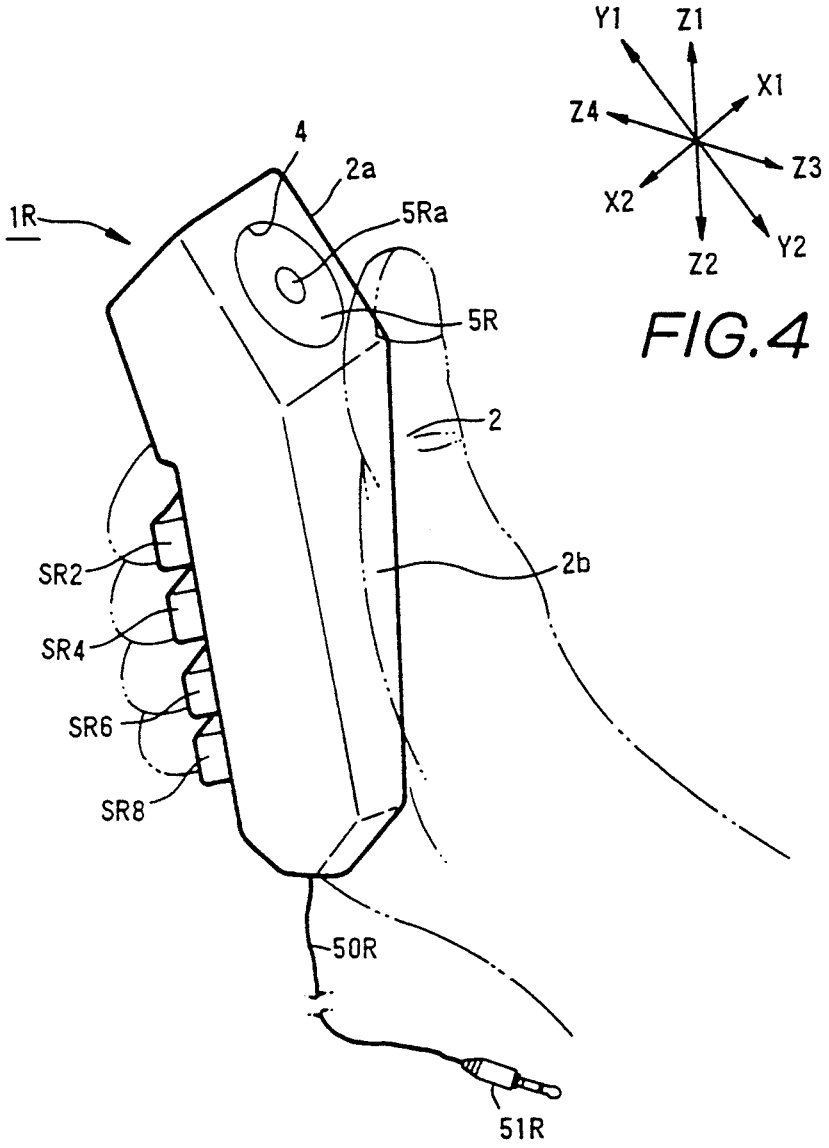
FIG. 1 is a perspective view showing grip 1R of the first embodiment.
FIG. 4 is a diagram showing directions of movement of operating indentation 5Ra.

Hereinafter, embodiments of the present invention are described by reference to drawings. FIG. 1 shows an outline of a grip which is a part of a musical tone control apparatus of a first embodiment. This grip is shown as a grip 1R for use in the right hand of a player.

In FIG. 1, numeral 2 designates a case having a rectangular shape, in which head portion 2*a* is formed by a given inclination, and an outline of main portion 2*b* is tapered from head portion 2*a* to the end portion thereof. Cable 50R is extended from the end of main portion 2*b*, and plug 51R is connected with the end of cable 50R. Accordingly, the base of the right thumb is placed on the front side of main portion 2*b*, and the palm of the right hand is placed on the right side surface of main portion 2*b*. The fingers, except for the thumb, are placed on the rear side of main portion 2*b*.

Figure 3:
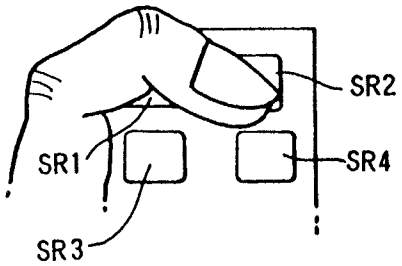
FIG. 3 is a front view showing a depressing state of push-button switch SR2 by the index finger of the right hand.
Figure 2:
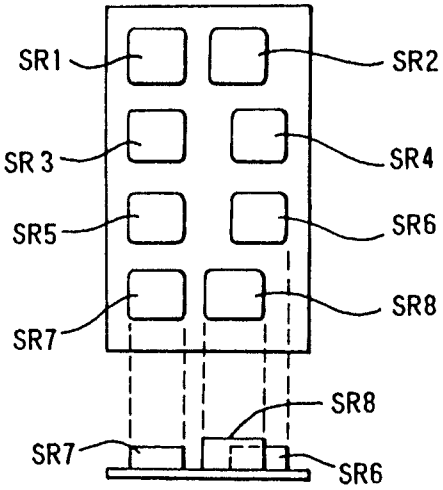
FIG. 2 is a front and side view showing a layout of push-button switches.
Figure 5A:
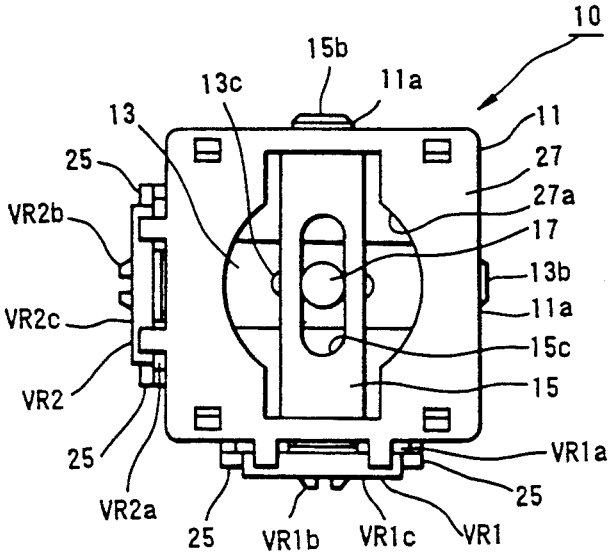
FIGS. 5(*a*) to 5(*d*) are plan and side views showing a variable resistor unit 10.
Figure 5D:
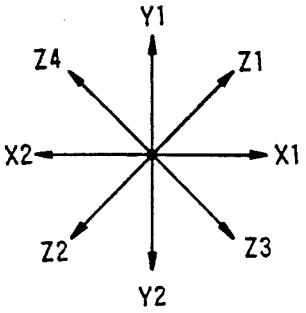
Figure 5B:
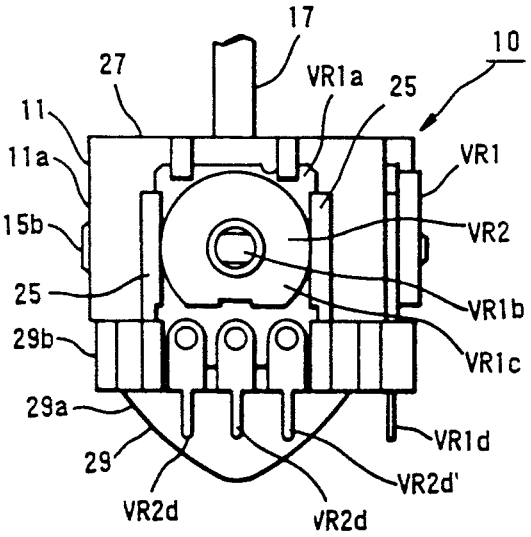
Figure 5C:
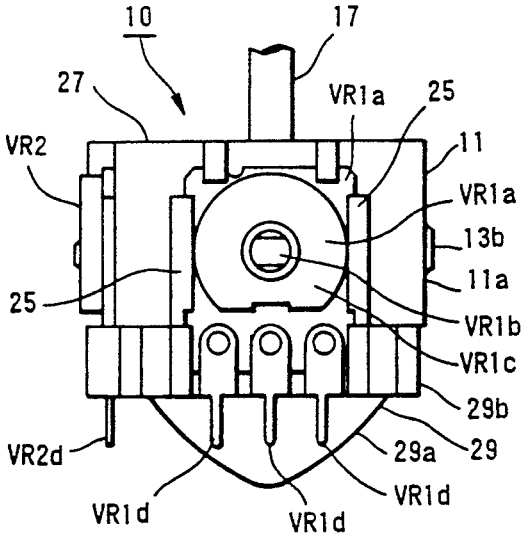

At the rear side of main portion 2*b*, eight push-button switches SR1 to SR8 are arranged so as to be depressed by the fingers as shown in FIG. 2, in which push-button switches SR1 and SR2 are depressed by the index finger, push-button switches SR3 and SR4 are depressed by the middle finger, push-button switches SR5 and SR6 are depressed by the third finger, and push-button switches SR7 and SR8 are depressed by the little finger. In addition, push-button switches SR2, SR4, SR6, and SR8 are arranged so as to be readily depressed depending on the length of the fingers, and also, the projection of push-button switches SR1, SR3, SR5, and SR7 is arranged a shorter arrangement than the others. That is, they are readily depressed by the fingers. For example, push-button switch SR2 is arranged on the far side of the rear surface, but the index finger can readily reach for push-button switch SR2 because push-button switch SR2 is positioned closer than push-buttons SR4 and SR6 towards the opposite push-button switches SR1, SR3, SR5, and SR7. Likewise push-button SR8 is positioned closer toward the opposite push-buttons. In addition, when push-button switch SR2 is depressed, push-button switch SR1 is not depressed by the index finger as shown in FIG. 3.

Referring back to FIG. 1, circular opening 4 is formed with the front surface of head portion 2*a*, and operating pad 5R projects from circular opening 4, as a circular ridge. Indentation 5Ra is also formed in the center of operating pad 5R. Accordingly, when the thumb touches indentation 5Ra in one of directions as shown in FIG. 4, an electric signal is produced from a variable resistor unit, which is described next.

Figure 6B:
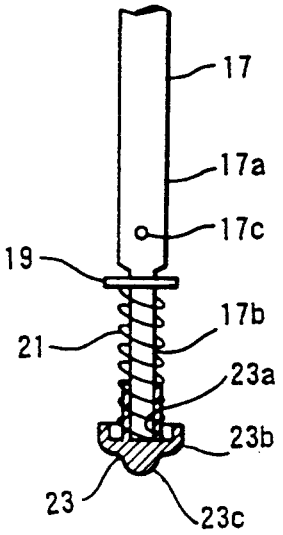
FIGS. 6(*a*) to 6(*c*) are side views showing components of the variable resistor unit 10.
Figure 6A:
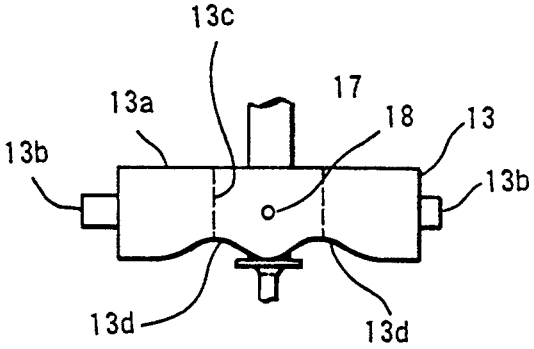
Figure 6C:
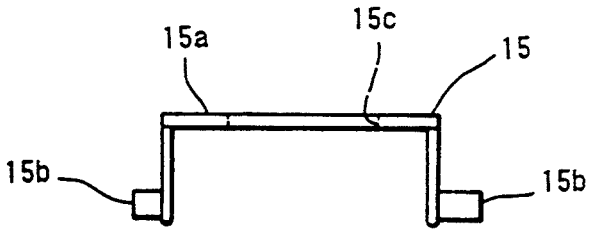

FIGS. 5 and 6 show the construction of a variable resistor unit 10 which is positioned under operating pad 5R. FIG. 5(*a*) shows a plan view of variable resistor unit 10, FIG. 5(*b*) shows a side view of the left, and FIG. 5(*c*) shows a front view. In these drawings, numeral 11 designates a rectangular case, each side surface of which has circular holes 11*a*. Conversion member 13 is pivotally mounted between two circular holes 11*a* on opposite sides of the four side surfaces.

A front view of conversion member 13 is shown in FIG. 6(*a*). Conversion member 13 comprises a rectangular bar 13*a*, and pivot pins 13*b* for inserting into both holes 11*a* which are formed in rectangular case 11. One side of rectangular bar 13*a* has a wavy surface 13*d*, in which a projection portion of wavy surface 13*d* is positioned in the center of wavy surface 13*d*. The other side of rectangular bar 13*a* has long hole 13*c* in the central position thereof. This long hole 13*c* is shown in FIG. 5(*a*). A conversion bar 17 is inserted into long hole 13*c*. This conversion bar 17 is pivotally mounted between inside walls of long hole 13*c* by pivot pin 18. Therefore, conversion bar 17 can be pivotally moved back and forth within long hole 13*c* in the directions of X1 and X2 shown by the arrows in FIG. 5(*d*). In addition, in FIG. 5(*d*), moving conversion bar 17 in the direction of Y1 shown by the arrow pivotally moves conversion member 13 toward the direction of Y1, while moving conversion bar 17 in the direction of Y2 shown by the arrow pivotally moves conversion member 13 toward the direction of Y2.

The details of conversion bar 17 are shown in FIG. 6(*b*). Conversion bar 17 has a thick portion 17*a* and a thin portion 17*b*, in which the lower portion of thick portion 17*a* has a hole 17*c* in which pivot pin 18 is inserted, and the upper portion of thick portion 17*a* is mounted to operating pad 5R. The upper portion of thin portion 17*b* has washer 19 which is placed around thin portion 17*b*, and coil spring 21 is also placed around thin portion 17*b*. Movable member 23 is slidably fitted over the end portion of thin portion 17*b*. Movable member 23 comprises a cylinder portion 23*a* into which thin portion 17*b* is inserted; a cover portion 23*b*; and a projection portion 23*c*. Accordingly, movable member 23 is urged by restoring force of coil spring 21.

Referring back to FIG. 5(*a*), another conversion member 15 is pivotally mounted between the other two holes 11*a*. This conversion member 15 is shown in FIG. 6(*c*). Conversion member 15 comprises a U-shaped plate 15*a*, and pivot pins 15*b* for inserting into holes 11*a*, which are attached to both vertical portions of conversion member 15. In addition, U-shaped plate 15*a* has a long hole 15*c* in the longitudinal direction thereof. Conversion bar 17 described above passes through long hole 15*c*. Accordingly, moving conversion bar 17 toward the direction of X1 shown by the arrow pivotally moves conversion member 15 toward the direction of X1, while moving conversion bar 17 toward the direction of X2 shown by the arrow pivotally moves conversion member 15 toward the direction of X2. In addition, when conversion bar 17 moves in the directions of Y1 and Y2, conversion bar 17 pivotally moves within long hole 15*c* which is formed in conversion member 15.

Referring back to FIGS. 5(*a*), 5(*b*), 5(*c*), and 5(*d*), mounting members 25 are formed on the side surfaces of rectangular case 11, and are also include one pivotal end of conversion members 13 and 15, respectively. In addition, mounting members 25 are formed in parallel on each side of each of the pivotal ends of conversion members 13 and 15. Rotation type variable resistors VR1 and VR2 are mounted between mounting members 25, in which variable resistor VR1 is mounted on the one side of conversion member 15, and variable resistor VR2 is mounted on the one end of conversion member 13, respectively. Variable resistor VR1 comprises a resistor board VR1*a*; a shaft VR1*b*; a slider (not shown in the drawings); a cover VR1*c*; and terminals VR1*d*. The end portion of shaft VR1*b* is coupled with the end portion of pivot pin 15*b*. Accordingly, moving conversion member 15 pivotally slides the slider along resistor board VR1*a*, so that the resistance value is changed corresponding to an angle of the rotation.

Similarly, the end portion of shaft VR2*b* is coupled with the end portion of pivot pin 13*b*. Variable resistor VR2 has a construction similar to variable resistor VR1, therefore, identical constructions are named by the same reference numerals corresponding to variable resistor VR1. A detailed description of variable resistor VR2 is therefore omitted for the sake of simplicity.

Accordingly, moving conversion bar 17 toward the direction of X1 shown by the arrow rotates the slider of variable resistor VR1 toward the direction of X1. Moving conversion bar 17 toward the direction of X2 shown by the arrow rotates variable resistor VR1 toward the direction of X2. Similarly, moving conversion bar 17 toward the direction of Y1 rotates variable resistor VR2 toward the same direction. Moving conversion bar 17 toward the direction of Y2 rotates variable resistor VR2 toward the same direction. In addition, moving conversion bar 17 toward the direction of Z1 shown by the arrow rotates variable resistor VR1 toward the direction of X1, and variable resistor VR2 toward the direction of Y1 shown by the arrow. Thus, moving conversion bar 17 moves two sliders of respective variable resistors VR1 and VR2, simultaneously.

Rectangular case 11 has a rectangular cap 27 having opening 27*a*. Conversion bar 17 penetrates into opening 27*a* as shown in FIGS. 5(*b*) and 5(*c*). In FIGS. 5(*b*) and 5(*c*), cap 29 is mounted on the lower portion of rectangular case 11. This cap 29 comprises a conic portion 29*a*, and a rectangular portion 29*b*. Movable member 23 slidably fitted onto conversion bar 17 contacts the inside and end surface of conic portion 29*a*. Accordingly, moving conversion bar 17 by hand in all direction in a plane moves movable member 23 in the upper direction along the inside surface of conic portion 29*a*. Releasing hand from conversion bar 17 moves movable member 23 in the lower direction along the inside surface of conic portion 29*a* by restoring force of coil spring 21, that is, movable member 23 moves toward the end portion of conic portion 29*a*, thereby returning conversion bar 17 to a perpendicular position.

Heretofore, grip 1R used for the right hand has been described, grip 1L used for the left hand is also prepared in symmetrical shape, however, a detail description of this construction is omitted for the sake of simplicity.

Figure 7:
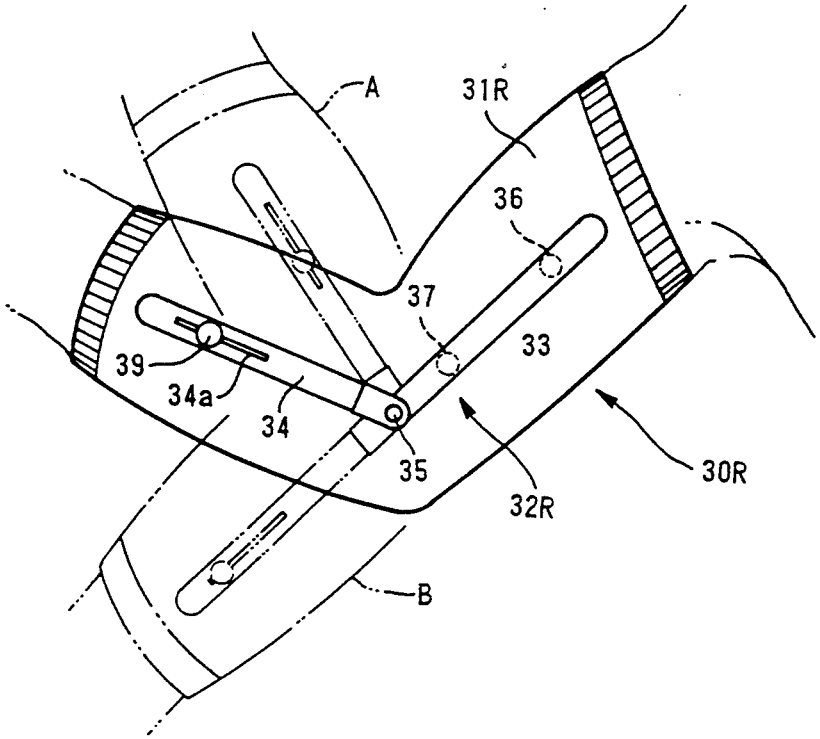
FIG. 7 is a side view showing a bending state of the elbow.

FIG. 7 shows elbow angle detector 30R which is attached to the right elbow of a player. This elbow angle detector 30R comprises a supporter 31R for attaching to the right elbow, and an angle detector 32R for detecting an angle of the elbow. Angle detector 32R has a plate 33 and a plate 34, each end of which is pivotally coupled by a pin 35. These plates 33 and 34 are made of a plastic material or the like, and each of the plates 33 and 34 is an approximately the same length. The plate 33 is removably attached to supporter 31R by fasteners 36 and 37. While the plate 34 has a long hole 34*a* in the longitudinal direction thereof, and a guide member 39 is slidably penetrated into long hole 34*a*, in which the end portion of guide member 39 is removably attached to supporter 31R by a fastener as well.

Figure 8:
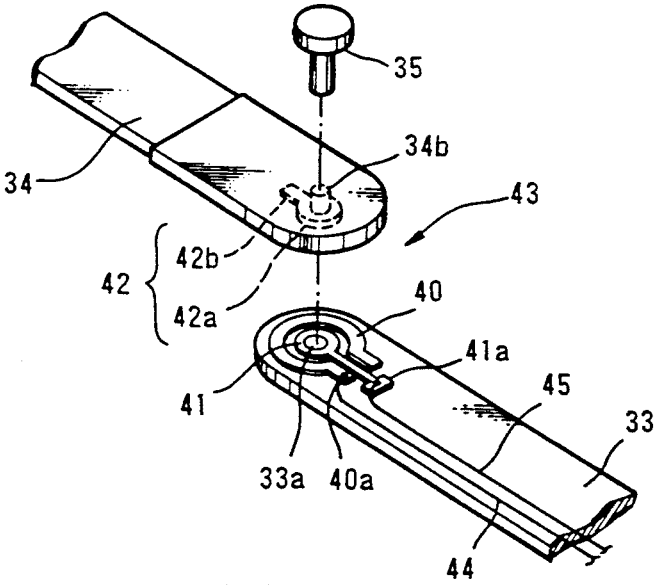
FIG. 8 is an exploded view showing a potentiometer 43.

In FIG. 8, potentiometer 43 is formed with a pivotal portion of respective plates 33 and 34. Plate 33 has a circular-shaped resistance element 40, and a fixed contact 41 which is surrounded by resistance element 40, and central portion of fixed contact 41 has a hole 33*a*. One end of resistance element 40 is formed with terminal 40*a* connected to a lead 44 which is also connected to grip 1R. A lead portion of fixed contact 41 is formed with terminal 41*a* connected to a lead 45 which is connected to grip 1R as well. Plate 34 has slide contact 42 which comprises a circular portion 42*a* and a lead portion 42*b*, in which the central portion of circular portion 42*a* has a hole 34*b*. Pin 35 is thus inserted into hole 34*b* and hole 33*a* so that plate 33 can pivotally move about plate 34. Thus, a variable resistance value can be obtained from leads 44 and 45 corresponding to an angle of the elbow.

The elbow angle detector 30R is attached to the elbow of a player as shown in FIG. 7. When the elbow moves toward the upper direction shown by chain double-dashed line A, and the lower direction shown by chain double-dashed line B, the plate 34 pivotally moves about pin 35. At this time, slide contact 42 slides along resistance element 40 to change the resistance value corresponding to an angle of the elbow. Moving the elbow moves guide member 39 along long hole 34*a*, so that the movement of the elbow remains smooth.

Heretofore, elbow angle detector 30R for the right elbow has been described. An elbow angle detector for the left elbow is also prepared in a symmetrical manner, however, a detailed description thereof is omitted for the sake of simplicity.

Figure 9:
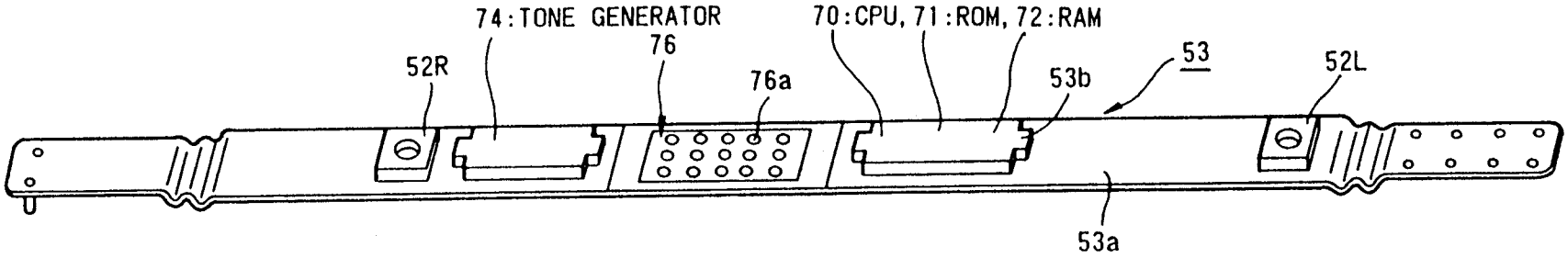
FIG. 9 is a perspective view showing a controller 53.

FIG. 9 shows controller 53, in which components of controller 53 are mounted on band 53*a*. Controller 53 comprises sockets 52R and 52L for connecting to grip 1R and elbow angle detector 30R for the right elbow, and grip 1L and elbow angle detector 30L for the left elbow; a circuit board 53*b* including a CPU 70, a ROM 71, a RAM 72, and a control circuit which includes A-D converters, registers, a timer, and the like; a tone generator 74 for generating musical tone; and a console 76 having push-switches 76*a*, in which ROM 71 stores a computer program for use in CPU 70, and RAM 72 is used for a work area. In addition to the above construction, other components are mounted on band 53*a*, such as a power supply, and the like.

According to the construction described above, a circuit diagram is described by reference to FIG. 10.

Each detected voltage signal from the variable resistors VR1 and VR2 is supplied to A-D converters 54R and 55R through cable 50R. A-D converters 54R and 55R convert each detected voltage signal into digital data composed of a predetermined number of bits, for example, seven bits, which then supplies the digital data to registers 57R and 59R, respectively. Registers 57R and 59R store the digital data, and then supplies the digital data, as detected voltage data VRD1 and VRD2 respectively, to bus line BS.

Each output signal from push-button switches SR1 to SR8 incorporated in grip 1R, is supplied to respective bits, for example eight bits, of register 63R through cable 50R. Register 63R stores each digital data, and then supplies the digital data, as switch-on data SONR, to bus line BS.

Detected voltage signals from angle detector 32R incorporated in elbow angle detector 30R, are supplied to A-D converter 67R through cables 65R and 50R.

A-D converter 67R converts detected voltage signals from angle detector 32R into digital data composed of a predetermined number of bits, for example seven bits, then supplies the digital data to register 69R. Register 69R stores the digital data, then supplies the digital data, as detected angle data $\theta$DR, to bus line BS.

Figure 10:
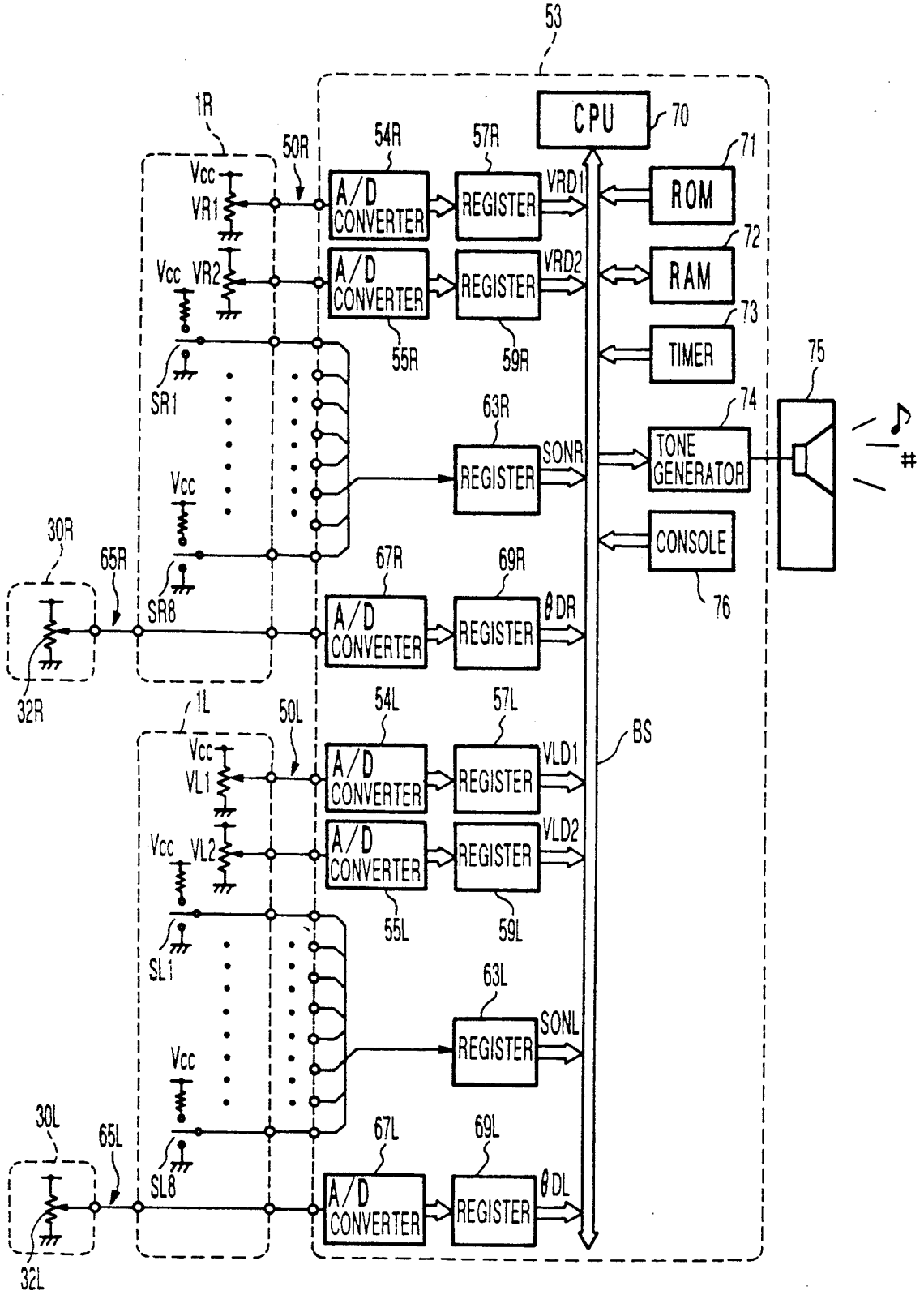
FIG. 10 is a circuit diagram showing the musical tone control apparatus of the first embodiment.

In grip 1L for the left hand and elbow angle detector 30L for the left elbow, an identical circuit is prepared for the left hand and the fingers as shown in FIG. 10, therefore, identical components are designated by corresponding reference numerals designated for the components of the right hand and fingers, and the detail description of these components is omitted for the sake of simplicity.

In such a construction, RAM 72 has the following registers;

REFX: standard value register for X direction
REFY: standard value register for Y direction
PARX: movement value register for X direction
PARY: movement value register for Y direction
MIN: minimum value register
MAX: maximum value register
DLT: difference value register
TH1: first threshold value register
TH2: second threshold value register Numeral 73 designates a timer for measuring interruption time of CPU 70.

A function of CPU 70 is now described. CPU 70 reads detected voltage data VRD1, VRD2, VLD1, and VLD2 stored in registers 57R, 59R, 57L, and 59L; switch-on data SONR and SONL stored in registers 63R and 63L; and detected angle data θDR and θDL stored in registers 69R and 69L. CPU 70 then produces key-code data KC for indicating a tone pitch; tone volume data VOL for indicating a tone volume; tone color data TD for indicating several types of tone colors; effect data KD for indicating several types of effects; and chord data WD for indicating several types of chords based on the reading data. Data produced data by CPU 70 in the above is referred to as musical tone control data, and is supplied to tone generator 74 through bus line BS.

Tone generator 74 produces a musical tone signal having a tone pitch corresponding to key-code data KC. The musical tone signal has a tone volume corresponding to tone volume data VOL; a tone color corresponding to tone color data TD; an effect corresponding to effect data KD; and a chord corresponding to chord data WD. Musical tone signal produced by tone generator 74 is supplied to musical tone generating apparatus 75 composed of amplifiers, speakers, and the like, to produce as a musical tone.

Console 76 has push-switches 76*a* which supply coded signals to bus line BS.

Figure 11:
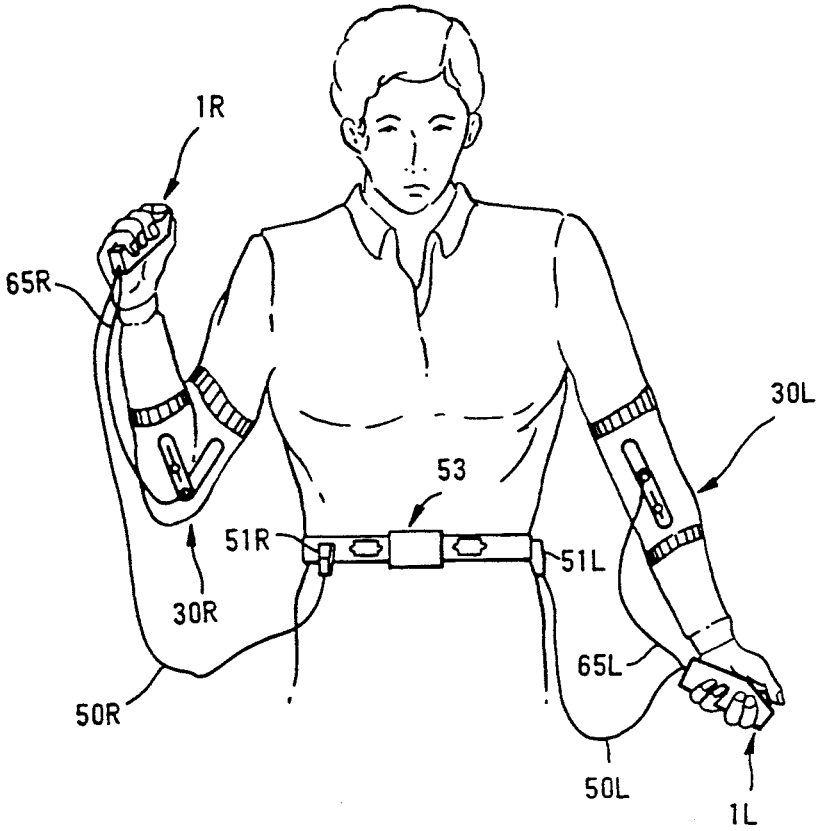
FIG. 11 is a perspective view showing a player having the musical tone control apparatus.

An operation of the musical tone control apparatus is described in accordance with the above construction. This operation is described for the case of the operation by the right hand and arm. To begin with, controller 53 is worn on the waist of a player as shown in FIG. 11, and then plug 51R of cable 50R extending from grip 1R is plugged into socket 52R of controller 53. The power supply in controller 53 and musical tone generating apparatus 75 is then turned on.

Depressing push-switches 76*a* on console 76 selects functions in accordance with states of push-button switches SR1 to SR8, variable resistors VR1 and VR2, and elbow angle detector 30R. For example, push-button switches SR1 to SR8, and variable resistors VR1 and VR2 are assigned to the function assignments as shown in FIG. 12. In addition, elbow angle detector 30R is assigned to the function assignments as shown in FIG. 13.

Elbow angle detector 30R having angle detector 32R is attached to the right elbow of a player, and also, the player holds grip 1R in his or her hand to depress a start-switch for starting a performance. Depressing the start-switch makes CPU 70 detects the functions for executing a program shown in FIG. 14(*a*).

In step S1, an initialization process is executed for the registers. That is, each of predetermined values is set in standard value registers REFX and REFY, minimum value register MIN, maximum value register MAX, difference value register DLT, movement value registers PARX and PARY, and threshold value registers TH1 and TH2. In this case, since a range of 7-bits data supplied to registers 57R, 59R, 57L, and 59L, is "0 to 7F" as in the hexadecimal system, each of standard value registers REFX and REFY is set to "40" which is the middle value of "0 to 7F"; minimum value register MIN and maximum value register MAX are set in "30" and "50", respectively; difference value register DLT is set in "8" as shown in FIG. 15(*a*). In addition, since a range of 7-bits data is supplied to registers 69R and 69L, threshold register TH1 is set to "30", and threshold register TH2 is set to "50" as shown in FIG. 15(*b*). Accordingly, the range of the 7-bits data is divided into three, that is, data "0 to 2F" is assigned to "upper", data "30 to 4F" is assigned to "middle", and data "50 to 7F" is assigned to "lower". In this case, in FIG. 7, the arm shown by the continuous line corresponds to "middle", the arm shown by the chain double-dashed line A corresponds to "upper", and the arm shown by the chain double-dashed line B corresponds to "lower". In addition, each of movement value registers PARX and PARY is set to "0", then the process moves to step S2.

In step S2, the process reads switch-on data SONR from register 63R, and moves to step S3.

In step S3, the process decides whether any push-button switches SR1 to SR8 are depressed or not. When the decision is "yes", the process moves to step S4, otherwise it moves to step S5.

In step S4, a switch-on process is executed in accordance with the function assignment as shown in FIG. 12. That is, depressing push-button switch SR4 by the middle finger produces the musical tone of tone pitch A, and depressing push-button switch SR7 by the little finger produces the musical tone of tone pitch C. Under this state, depressing push-button switch SR1 by the index finger produces the musical tone of tone pitch C#. The process then moves to step S5.

In step S5, the process reads detected angle data θDR from register 69R, then moves to step S6.

In step S6, an octave control is executed in accordance with detected angle data θDR. That is, when at least one of push-button switches SR2 to SR8 is turned on, bending the right arm a shown by the chain double-dashed line A produces a musical tone having a tone pitch which is one octave higher than a tone pitch corresponding to a depressed push-button switch. Stretching the arm as shown by the chain double-dashed line B produces a musical tone having a tone pitch which is one octave lower than a tone pitch corresponding to a depressed push-button switch The process then moves to step S7.

In step S7, other processes are executed, for example, tone color such as piano is indicated based on a push-switch incorporated in console 76 for use in a tone color selection. The process then returns to step S2.

Figure 14:
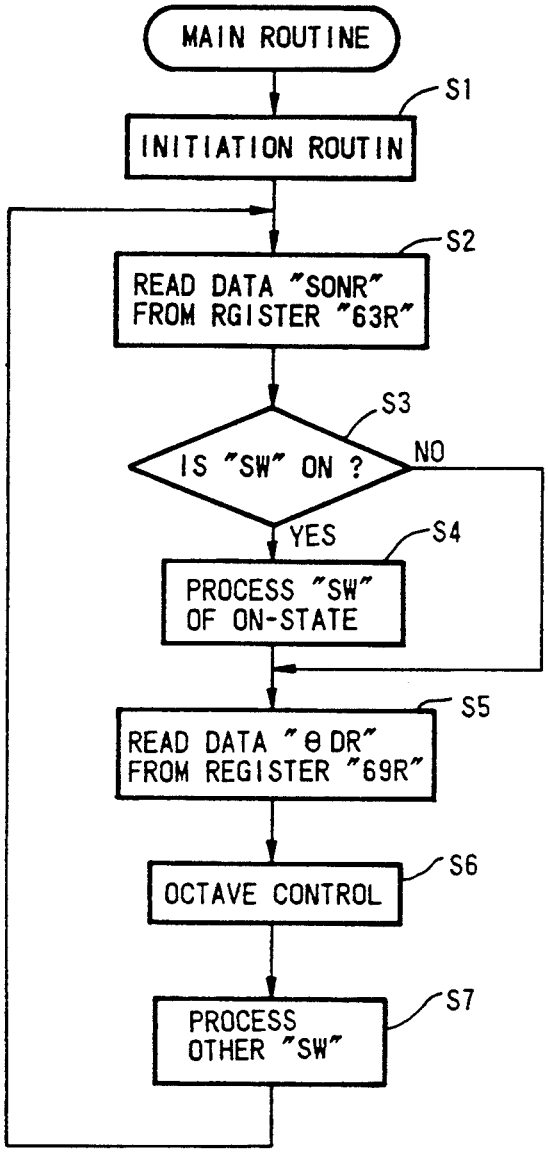
FIGS. 14(*a*) and 14(*b*) are flow charts showing function of CPU 70.
Figure 14:
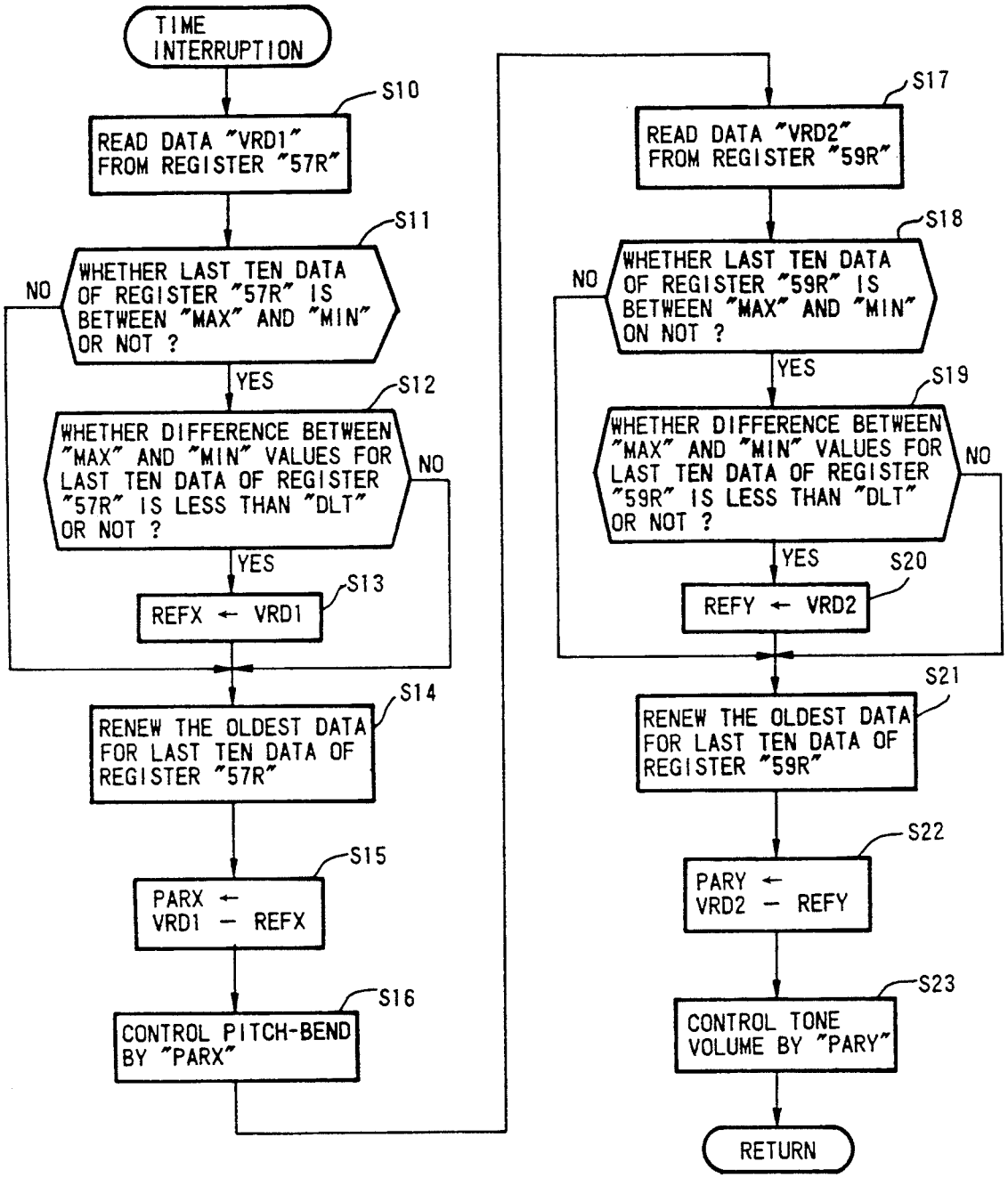

On the other hand, CPU 70 executes a process as shown in FIG. 14(*b*), at every predetermined period based on an interruption.

In step S10, the process reads detected voltage data VRD1 from register 57R, then moves to step S11.

In step S11, the process decides whether the last ten data read from register 57R ranges from the value stored in maximum value register MAX to the value stored in minimum value register MIN, or not. When the decision is "yes", the process moves to step S11, otherwise it moves to step S14.

In step S12, the process decides whether the difference value between the maximum value max. and the minimum value min. out of the last ten data read from register 57R is less than the value stored in difference register DLT, or not. When the decision is "yes", the process moves to step S13, otherwise it moves to step S14.

In step S13, data VRD1 from register 57R is set in standard value register REFX, that is, setting a middle point is executed, then the process moves to step S14.

In step S14, the oldest data out of the last ten data read from register 57R is deleted, and the newest data is written into register 57R, then the process moves to step S15.

In step S15 the value stored in standard value register REFX is subtracted from data VRD1 stored in register 57R, the difference value is set in movement value register PARX, then the process moves to step S16.

In step S16, the magnitude of a pitch-bend (referring to FIG. 12) is controlled by the value of movement value register PARX.

Accordingly, moving operating pad 5R in the direction of X1, shown by the arrow in FIG. 5, controls the musical tone having tone pitch corresponding to depressed push-button switches SR2 to SR8 with the pitch-bend, then the process moves to step S17.

In step S17, data VRD2 is read from register 59R, then the process moves to step S18.

In step S18, the process decides whether the last ten data read from register 59R ranges from the value stored in maximum value register MAX to the value stored in minimum value register MIN, or not. When the decision is "yes", the process moves to step S19, otherwise it moves to step S21.

In step S19, the process decides whether the difference value between the maximum value max and the minimum value min. out of the last ten data read from register 59R is less than the value from difference value register DLT, or not. When the decision is "yes", the process moves to step S20, otherwise it moves to step S21. In step S20, data VRD2 stored in register 59R is set in standard value register REFY, that is, setting the middle point is executed, then the process moves to step S21.

In step S21, the oldest data out of last ten data read from register 59R is deleted, and the newest data is written into register 59R, then the process moves to step S22.

In step S22, the value from standard value register REFY is subtracted from data VRD2 from register 59R, the difference value is set in movement value register PARY. then the process moves to step S23.

In step S23, the control of a tone volume is executed in accordance with the value of movement value register PARY.

Accordingly, moving operating pad 5R in the direction of Y1 shown by the arrow (referring to FIG. 4) controls a musical tone having a tone pitch corresponding to depressed push-button switches to a tone volume corresponding to a magnitude of movement. The process then moves out from the whole routine.

Figure 16:
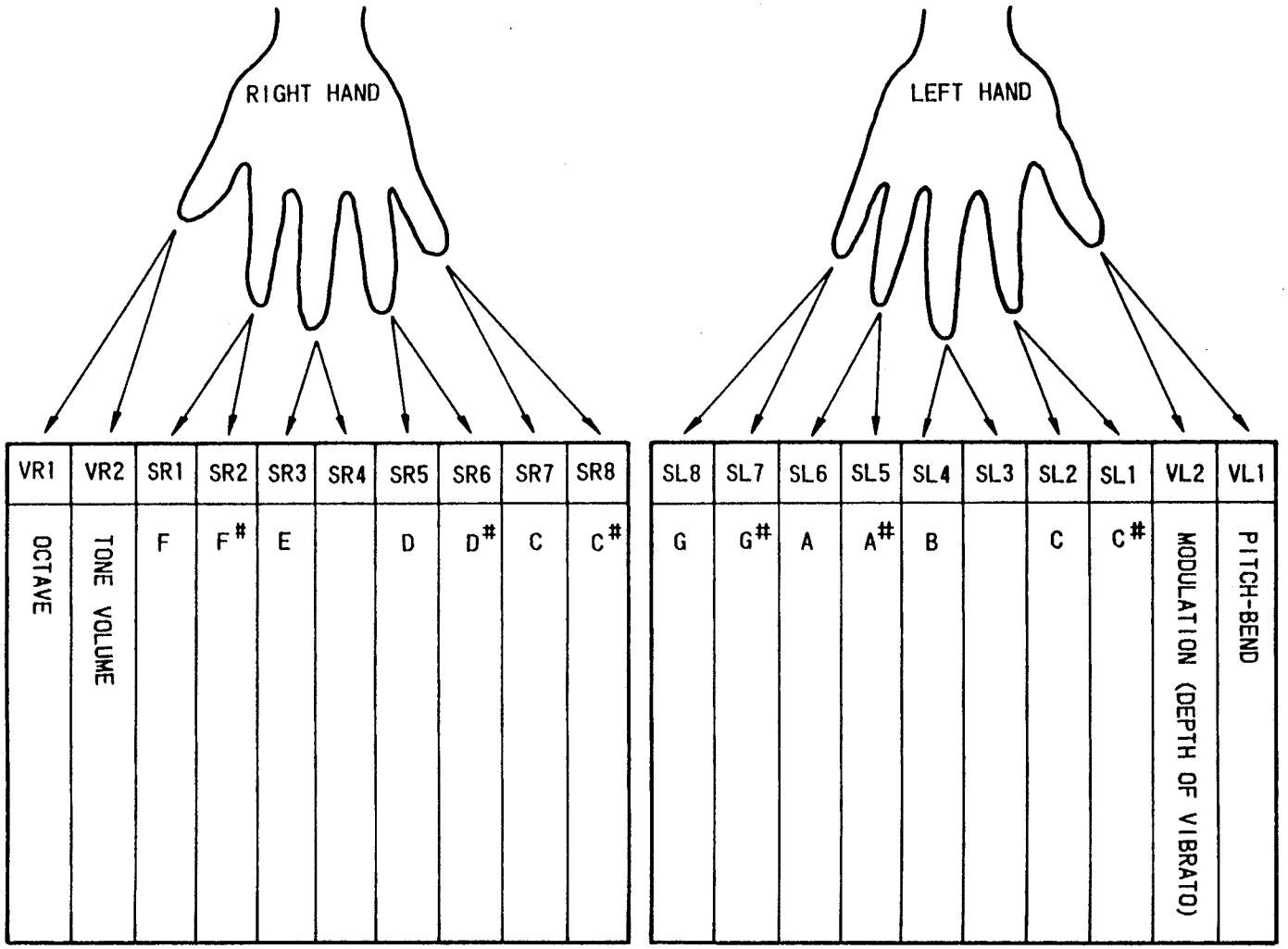
FIG. 16 is a diagram showing function assignments of both grip 1R and grip 1L.

FIG. 16 shows function assignments (corresponding to keyboard) which indicate states when a player holds both grip 1R by the right hand and grip 1L by the left hand. In the case where the function assignment is executed, for example, depressing push-button switch SR3 by the right middle finger produces the musical tone having tone pitch E, and under this state, moving operating pad 5R in the direction of X1 (referring to FIG. 4) by the right thumb produces the musical tone having tone pitch E which is one octave higher than the octave corresponding to the magnitude of movement. In addition, moving operating button 5L in the direction of X2 (referring to FIG. 4) by the left thumb controls the musical tone having tone pitch E corresponding to the magnitude of a pitch-bend.

Figure 17:
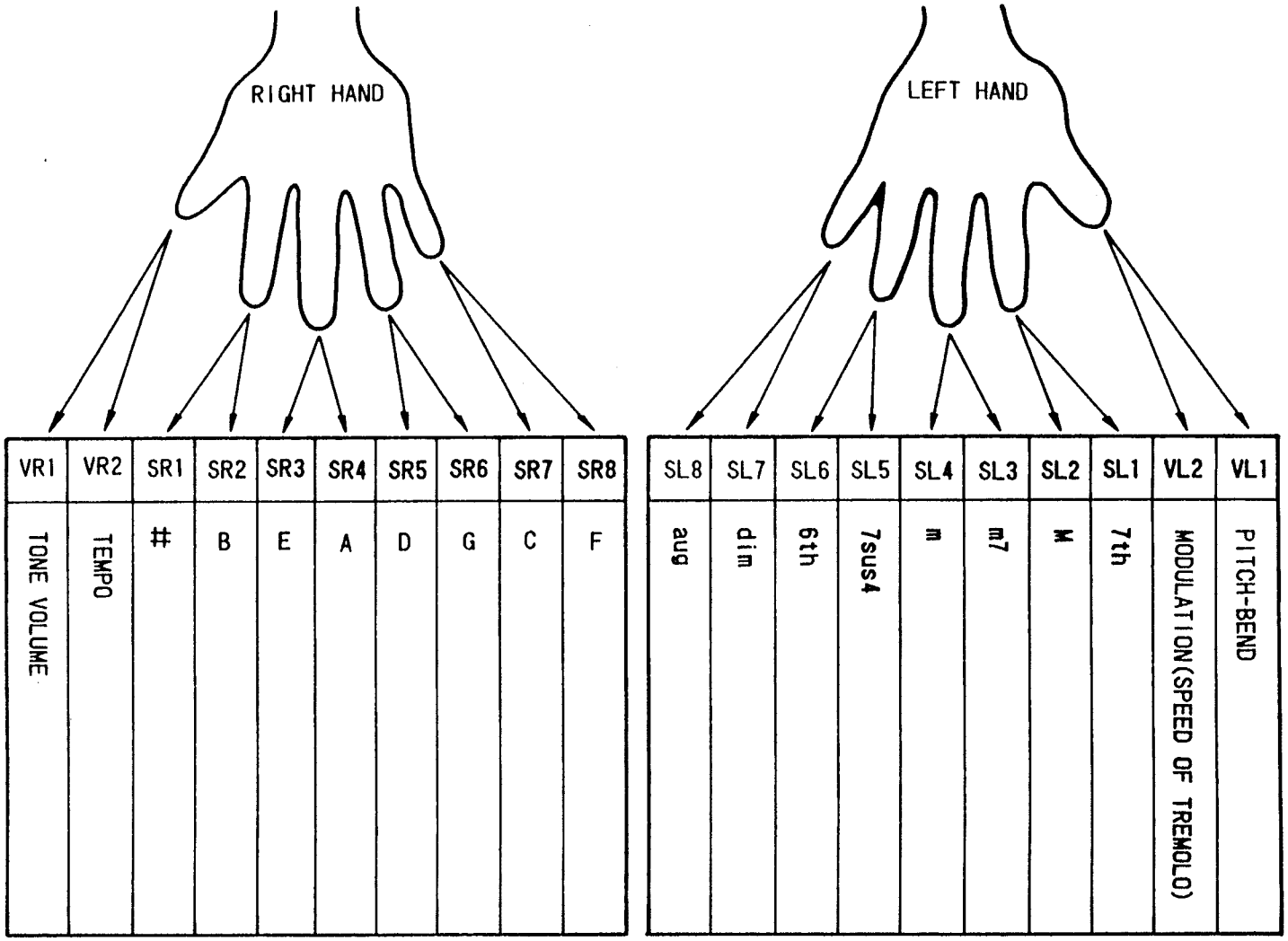
FIG. 17 is a diagram showing other function assignments of both grip 1R and grip 1L.

FIG. 17 shows other function assignments (corresponding to chords) which indicate states when a player holds both grips 1R and 1L. In the case where the function assignment is executed for example, depressing push-button switch SR6 by the right third finger produces the musical tone having tone pitch G, and under this state, depressing push-button switch SL1 by the left index finger produces the chord of G seventh. Then moving operating pad 5R in the direction of Z1 (referring to FIG. 4) by the right thumb increases the tone volume of the chord corresponding to G seventh, and also, the tempo becomes faster.

Figure 18:
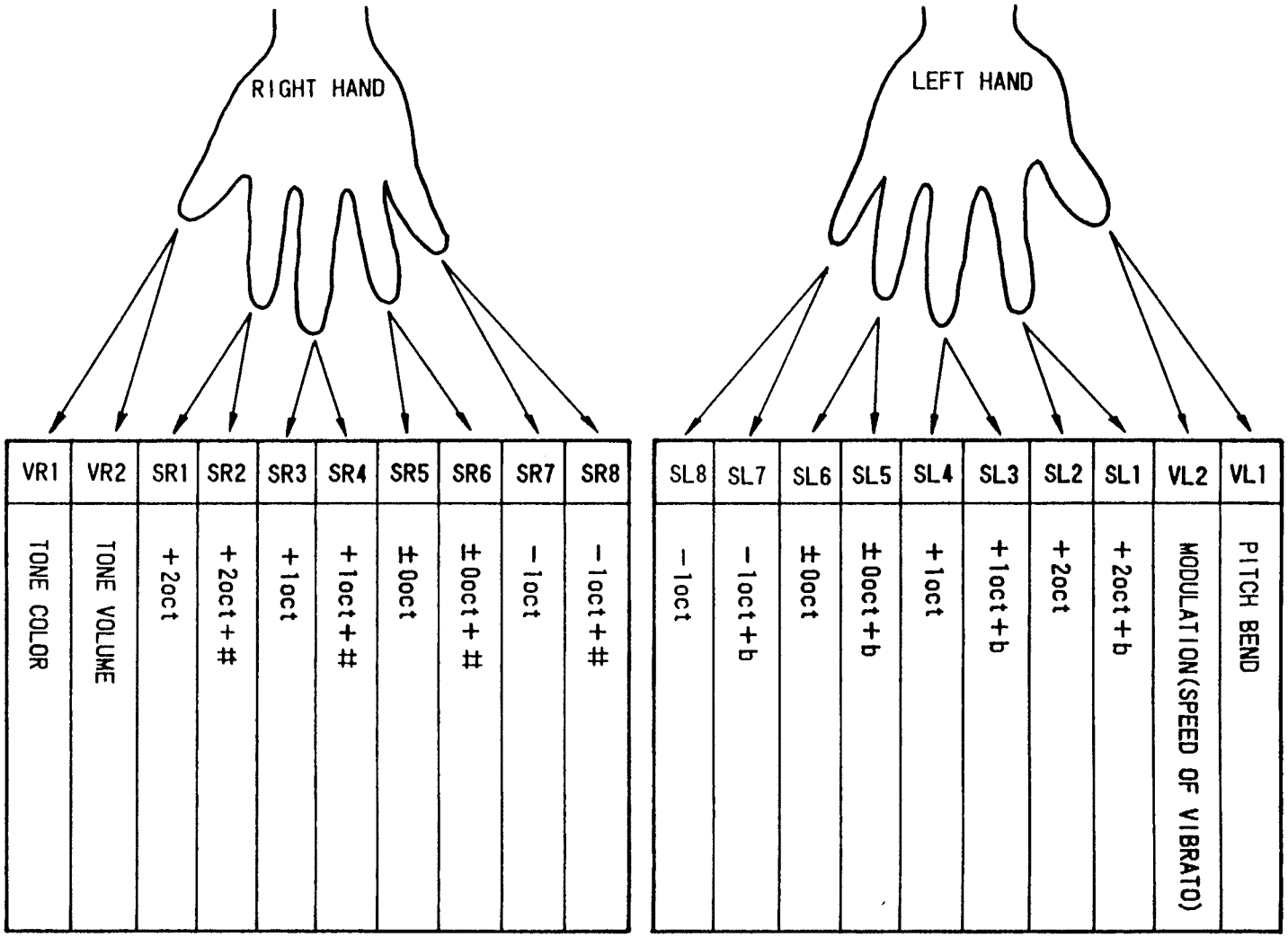
FIGS. 18 and 19 are diagrams showing function assignments of both grip 1R and grip 1L, and elbow angle detectors 30R and 30L.
Figures 19, 21:
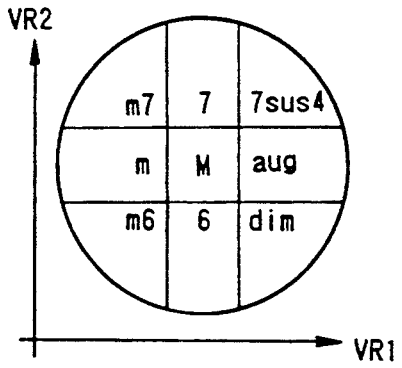
FIG. 21 is a diagram showing function assignments of the variable resistor unit 10.

FIGS. 18 and 19 show other function assignments which indicate states when a player holds both grips 1R and 1L, and also, wears elbow angle detectors 30R and 30L for the right and left arms. In the case where the function assignment is executed, for example, stretching both arms produces the musical tone having tone pitch B, and under this state, depressing push-button switch SR1 by the right index finger produces the musical tone having tone pitch B which is two octaves higher than a given octave. Additionally under the above state, moving operating button 5L in the direction of Y1 (referring to FIG. 4) by the left thumb produces the musical tone having tone pitch B which has a speed of vibrato corresponding to the magnitude of the movement.

Figure 20:
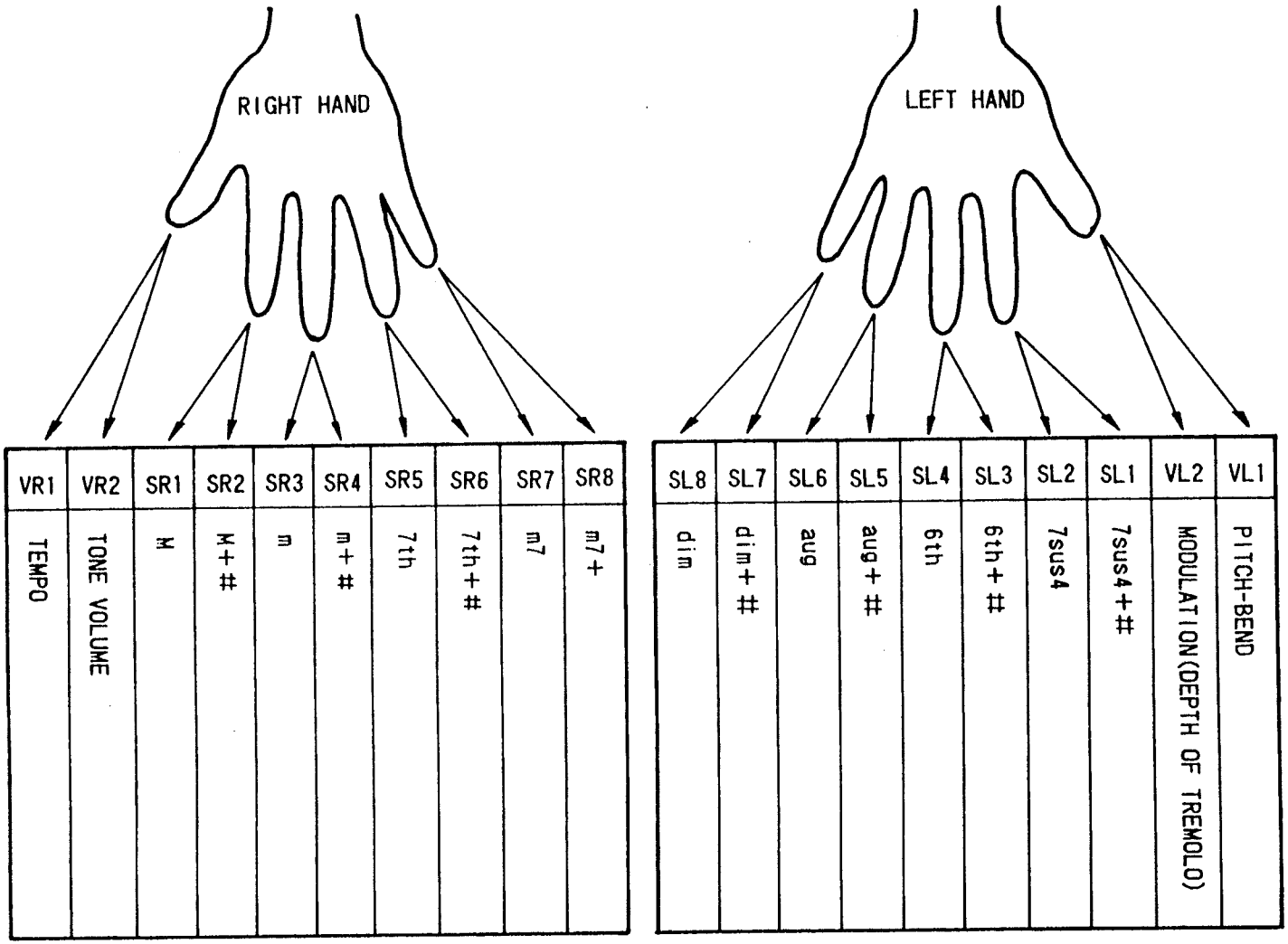
FIG. 20 is a diagram showing other function assignments of both grip 1R and grip 1L, and elbow angle detectors 30R and 30L.

FIG. 20 shows other function assignments which indicate the states when a player holds both grips 1R and 1L, and also, wears both elbow angle detectors 30R and 30L. The function assignment for elbow angle detectors 30R and 30L is omitted because the function assignments are the same one as those shown in FIG. 19 which have already been described. When executing the function assignment, for example, stretching the right arm and bending the left arm produces the musical tone having tone pitch E, and under this state, depressing push-button switch SR7 by the right little finger produces the chord having tone pitch E and minor seven. Additionally under the above states, moving operating button 5L in the direction of X1 (referring to FIG. 5) by the left thumb controls the chord having tone pitch E and minor seventh corresponding to the magnitude of the movement.

In another case, the brightness of the tone color can be controlled by the output signal of variable resistors VR1, VR2, VL1, or VL2.

In another case, each modulation of the effect tone can be controlled by an absolute value of the output signals from variable resistors VR1, VR2, VL1, and VL2.

In another case, the magnitude of an initial touch in turning the push-button switch on can be controlled by the output signals of variable resistors VR1, VR2, VL1, and VL2. In such a case, after turning the push-button switch on, the function indicated by the push-button switch does not have an influence on other push-button switches, even though the output signal of variable resistor VR1 is changed.

In another case, the control of the octave can be carried out by setting threshold values corresponding to the output signals of variable resistors VR1, VR2, VL1, and VL2.

In another case, the indication of the chord can be determined by either both the output signals from variable resistors VR1 and VR2, or both the output signals from variable resistors VL1 and VL2 as shown in FIG. 21.

In another case, the information transmission from grips 1R and 1L, and elbow angle detectors 30R and 30L to controller 53 can be carried out by either after A-D conversion by A-D converters 54R, 55R, 67R, 54L, 55L, and 67L, or by wireless.

In another case, the processes of step S5 and S6 shown in FIG. 14(*a*) can be carried out by the routine of the time interruption.

Figure 22:
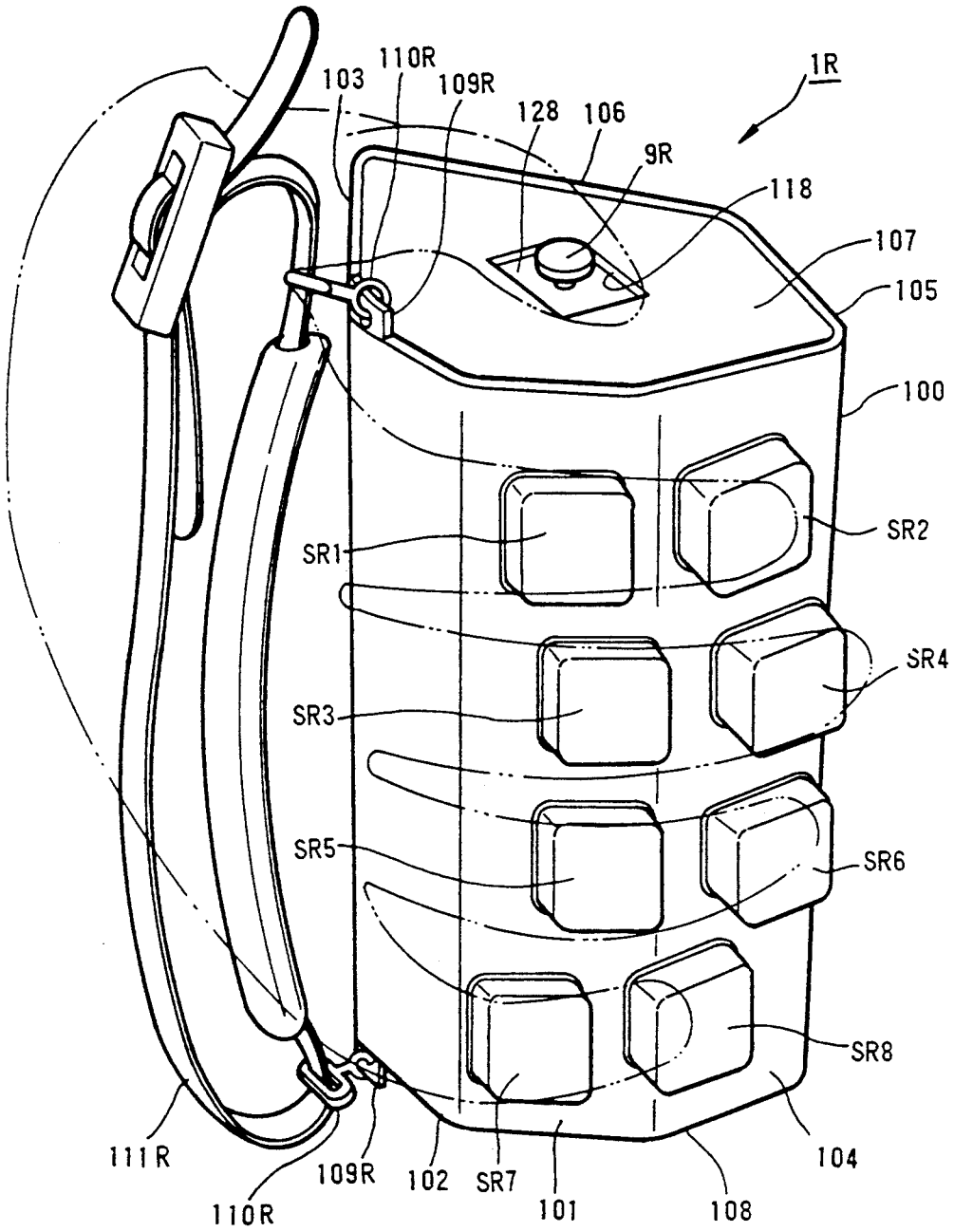
FIG. 22 is a perspective view showing grip 1R of the second embodiment.

FIG. 22 shows a grip 1R of a second embodiment which is used for the right hand of a player. This grip 1R has constructions similar to the first embodiment, therefore, the same constructions are designated by the same reference numerals.

In FIG. 22, numeral 100 designates a case hexagonal in cross section which has a group of side surfaces 101, 102, and 103; and a group of side surfaces 104, 105, and 106, both groups of surfaces being symmetrically formed on either side of a plane which forms a longitudinal cross section of case 100, the plane being paralleled to the longitudinal axis of case 100 and running through the intersection of side surfaces 103 and 106, and the intersection of side surfaces 101 and 104, and also, case 100 has top surface 105 and bottom surface 108. Accordingly, the palm of the right hand is placed on side surface 103, the thumb is placed on side surface 105, and the four fingers are placed on side surfaces 101 and 104.

Attaching members 109R are formed with top surface 107 and bottom surface 108, of each intersection of side surfaces 102 and 103, each attaching member 109R having fitting 110R to be attached to adjustable belt 111R, allowing grip 1R to attach to the right hand.

Side surfaces 101 and 104 have push-button switches, in which push-button switches SR1, SR3, SR5, and SR7 are arranged on side surface 101, and also push-button switches SR2, SR4, SR6, and SR8 are arranged on side surface 104 so that the four fingers can depress push-button switches SR1 to SR8. That is, push-button switches SR1 and SR2 are arranged so as to be depressed by the index finger, push-button switches SR3 and SR4 are arranged so as to be depressed by the middle finger, push-button switches SR5 and SR6 are arranged so as to be depressed by the third finger, and push-button switches SR7 and SR8 are arranged so as to depress by the little finger. In addition, push-button switches SR2, SR4, SR6, and SR8 protrude further from side surface 104 than push-button switches SR1, SR3, SR5, and SR7, so that they are readily depressed by the fingers, even though these push-buttons are arranged on side surface 104 further than side surface 101 from the hand as shown in FIG. 23.

FIG. 24 shows the construction of push-button switch SR1 which has a construction similar to the other push-button switches.

In FIG. 24(*a*), numeral 112 designates a circuit board, one side of which has terminals 112*a*, 112*b*, and 112*c*, these terminals being connected to a circuit formed on circuit board 112. In FIG. 24(*b*), resilient member 113 is positioned at a predetermined distance from circuit board 112, and is made of a silicone rubber, or the like, having projection portion 113*a* formed on one side at a central part thereof. On the other side of resilient member 113, a rubber-made switching member 114 is attached along resilient member 113, which also has cylindrical portion 114*a*, the central portion of which has projection bar 114*b*, and also, the length of projection bar 114*b* is shorter than that of cylindrical portion 114*a*. The circular end of cylindrical portion 114*a* and the end portion of projection bar 114*b* have terminals which are formed by a carbon material, or the like, forming a conductive portion. Accordingly, a first normally-open contact AR1 is formed between the end portion of cylindrical portion 114*a* and one side of circuit board 112, while a second normally-open contact BR1 is formed between the end portion of projection bar 114*b* and one side of circuit board 112, thus, resilient member 113 can move toward circuit board 112 to make conductive states. In FIG. 24(*c*), guide member 115 is mounted above resilient member 113, which has opening 115*a*. Slide member 116 is therefore inserted into opening 115*a*, which also has recesses 116*a* divided into four sections in cross section thereof, and a solid lead, or the like is inserted into each recess 116*a*, so that a weight of push-button switch SR1 can be adjusted depending on a volume of the lead in operation. In addition, one side of slide member 116 has concave portion 116*b* which receives projection portion 113*a*, and the other side of slide member 116 has circular solid 117, the upper side of which also has cap 118.

Accordingly, depressing push-button switch SR1, that is cap 118 downwardly slides slide member 116, so that resilient member 113 is moved downward to close first normally-open contact AR1. Depressing push-button switch SR1 furthermore moves resilient member 113 downwardly to thereby close second normally-open contact BR1. On the other hand, releasing push-button switch SR1 returns resilient member 113 and switching member 114 to the original position, so that slide member 116 is returned to the original position which is limited by a stopper, in which this returning movement is moved by the restoring force of resilient member 113. Thus, push-button switch SR1 is composed of a double-stages type switch.

Referring back to FIG. 22 and FIG. 23, rectangular opening 118 is formed with the central portion of top surface 107, and operating button 9R is projected from rectangular opening 118 which is moved by the right thumb.

Figure 25:
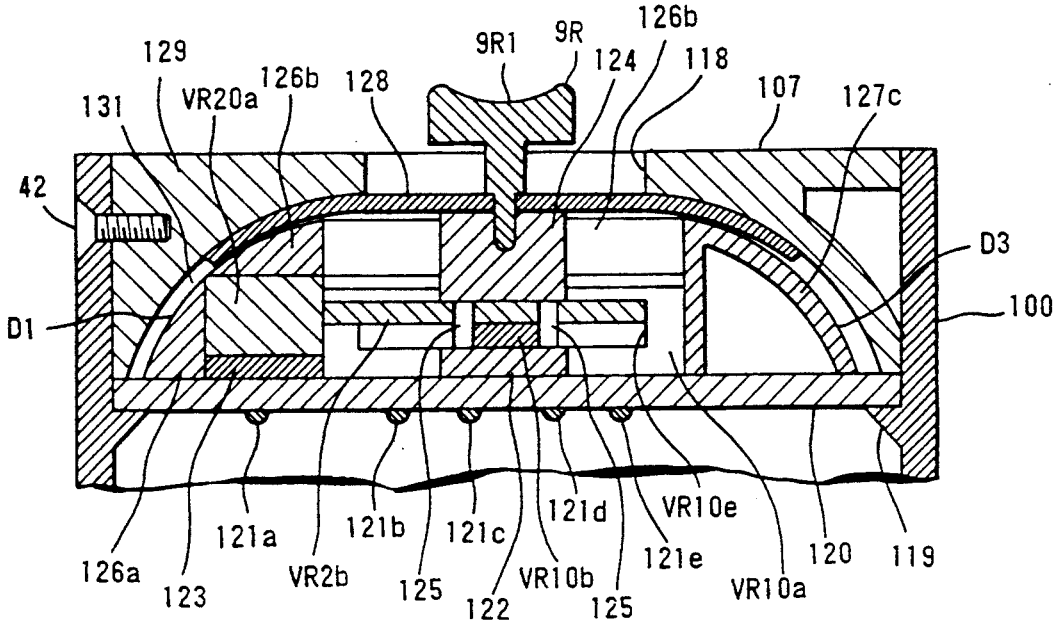
FIG. 25 is a section view shown by arrows A—A in FIG. 23.
Figure 26:
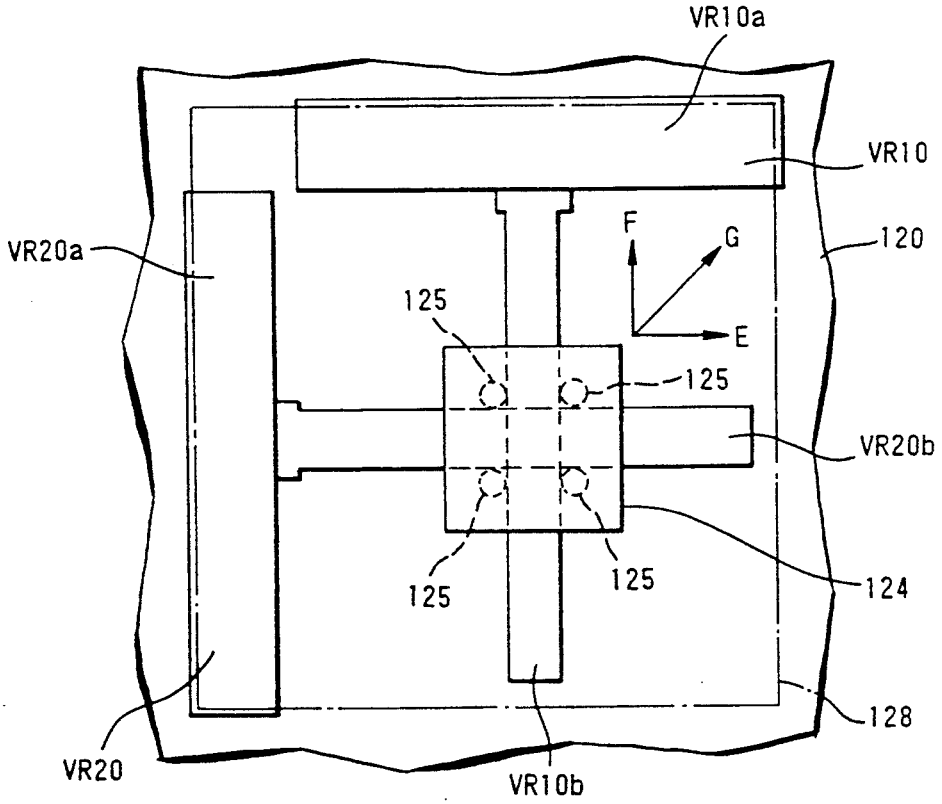
FIG. 26 is a partially cut plan view showing slide variable resistors VR10 and VR20.

Operating button 9R is shown in FIG. 25. This drawing shows a section view, cut away, of the arrows A-A shown by FIG. 23. In this drawing, numeral 119 designates a flange formed around the inside of case 100, and circuit board 120 is placed on flange 119. One side of circuit board 120 has few terminals which are not shown in FIG. 25, and the other side thereof has terminals 121*a*, 121*b*, 121*c*, 121*d*, and 121*e*. In addition, slide variable resistor VR10 is placed on slide member 122 which is arranged on circuit board 120, therefore, slide member 122 is intervened between circuit board 120 and slide variable resistor VR10. In FIG. 26, slide variable resistor VR10 comprises resistor portion VR10*a* and operating bar VR10*b*, in which resistor portion VR10*a* is placed along one edge side of circuit board 120, and indirect operation portion VR10*b* is extended from resistor portion VR10*a*, as T-shaped manner, to the opposite edge side of circuit board 120. Referring back to FIG. 26, resistor portion VR10*a* is a rectangularly-solid shape and has slit VR10*c* for sliding operating bar VR10*b* which is extended from slit VR10*c*. The end portion of resistor portion VR10*a* also has output terminals connected to the terminals which are formed with one side of circuit board 120, while operating bar VR10*b* is a rectangular-shaped plate. Accordingly, moving operating bar VR10*b* changes resistance value corresponding to a distance of the movement. Similarly in FIG. 26, slide variable resistor VR20 is placed on spacer 123 which is arranged on circuit board 120, therefore, spacer 123 is intervened between slide variable resistor VR20 and circuit board 120. Slide variable resistor VR20 comprises resistor portion VR20*a* and operating bar VR20*b*, in which resistor portion VR20*a* is placed along the other edge of circuit board 120 and operating bar VR20*b* is extended from resistor portion VR20*a* to the opposite edge side of circuit board 120, so that the direction of resistor portion VR10*a* is arranged for the right angle with respect to the direction of resistor portion VR20*a*, and the central portion of operating bar VR10*b* is intersected at the central portion of operating bar VR20*b*, and also operating bar VRA20*b* is positioned on operating bar VR10*b*.

Slide member 124 is attached to the upper side of the intersecting portion where both operating bars VR10*b* and VR20*b* are intersected by each other, which is also supported by four posts 125 placed on slide member 124, and each post 125 is positioned at the right angle corner formed by the intersection of operating bars VR10*b* and VR20*b*, thus these posts 125 guide the movement of both operating bars VR10*b* and VR20*b*.

Accordingly, moving slide member 124 in the direction shown by the arrow E moves operating bar VR10*b* in the direction shown by the arrow E. Moving slide member 124 in the direction shown by the arrow F moves operating bar VR20*b* in the direction shown by the arrow F. Moving slide member 124 in the direction shown by the arrow G moves operating bar VR10*b* in the direction shown by the arrow E, and also, moves operating bar VR20*b* in the direction shown by the arrow F. Thus, by moving one slide member 124 to the given directions, two operating bars VR10*b* and VR20*b* can be moved in the given directions.

Additionally, in FIG. 25, guide members 126*a* and 126*b* are attached along the left and upper surfaces of the resistor portion VR20*a*, respectively, and each of the guide members 126*a* and 126*b* has an arc portion, each arc portion being formed with a quarter of a circle cross section thereof, which is referred to as arc surface D1. Similarly, guide members 126*a* and 126*b* are attached along the far side and upper surfaces of resistor portion VR10*a*, respectively, so that both the arc portions of guide members 126*a* and 126*b* are formed with a quarter of a circle in cross section thereof, which is referred to as arc surface D2 (not shown in the drawing). In addition, in FIG. 25, guide members 127*c* are attached to the opposite sides of resistor portions VR10*a* and VR20*a*, respectively. Each of the guide members 127*c* also has a quarter of a circle cross section with a space inside which is referred as arc surfaces D3 and D4 (both are not shown in the drawing). Accordingly, slide member 124 is arranged within arc surfaces D1 to D4.

In addition, in FIGS. 25 and 26, cover plate 128 is placed on the area including arc surfaces D1 to D4, and slide member 124, which is made of a plastic material, or the like having flexibility. In FIG. 25, the end of operating button 9R penetrates into cover plate 128, and is inserted into slide member 124 the top surface of operating button 9R having indentation 9R1.

Figure 27:
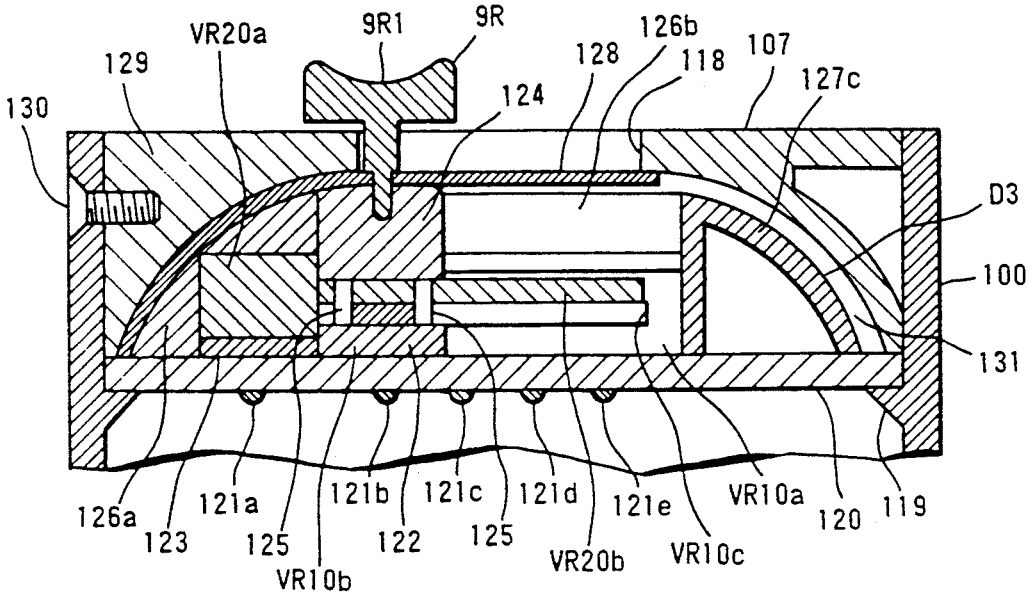
FIG. 27 is a section view showing a state in which operating button 9R is moved to one end.

Upper surface member 129 is mounted along the outer Surface of cover plate 128, and fixed by screw 130 through case 100, and also, the concave surface of upper surface member 129 is placed apart from arc surfaces D1 to D4 with given distance 131. Accordingly, moving operating button 9R in the left direction as shown in FIG. 27 moves cover plate 128 in the left direction, thus cover plate 128 moves in given distance 131, and operating button 9R can be moved in the direction shown by the arrows X1, X2, Y1, and Y2 within rectangular opening 118 as shown FIG. 23.

Thus, both slide variable resistors VR10 and VR20 are arranged so that both operating bars VR10*b* and VR20*b* thereof intersect each other to enable movement of the intersected portion of operating bars VR10*b* and VR20*b* by operating operating button 9R. Because of this, the configuration of the operating switch can be of a thinner-type in comparison with a rotary-type variable resistor. Furthermore, cover plate 128 is mounted between operating button 9R, and slide variable resistors VR10 and VR20 and moves along arc surfaces D1 to D4, so that the movement of operating button 9R can be within a large area.

Heretofore, grip 1R for the right hand has been described. Grip 1L is also prepared for the left hand similar to grip 1R, but does not have a switch such as operating button 9R nor slide variable resistors VR10 and VR20. The description of grip 1L is omitted for the sake of simplicity. These grips 1R and 1L are held by the hand of a player, and connected to a controller which is worn on the waist of a player as shown in FIG. 11.

Figure 28:
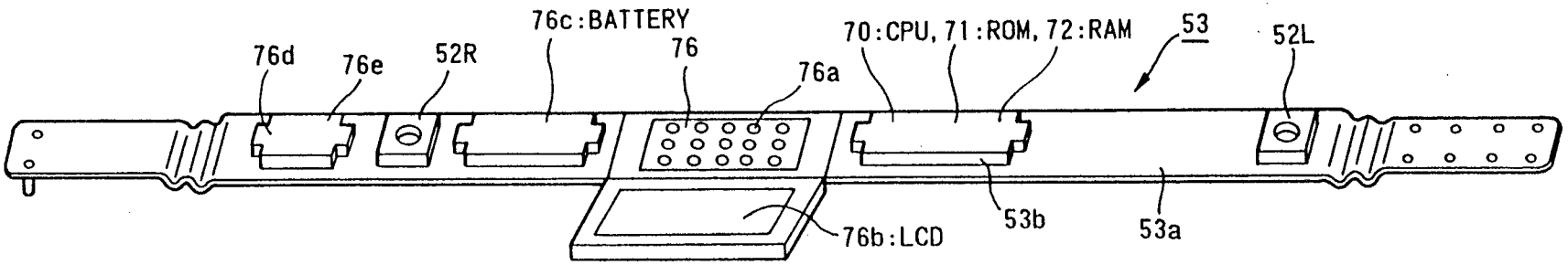
FIG. 28 is a perspective view showing controller 53 of the second embodiment.

FIG. 28 shows controller 53 which has a construction similar to that of FIG. 9. The feature of this controller 53 that it has a LCD (liquid crystal display) 76*b*, a battery 76*c*, MIDI (musical instrument digital interface) circuit 76*d*, and transmitter 76*e*, in which MIDI circuit 76*d* and transmitter 76*e* are mounted on a circuit board. The rest of the construction is designated by the same reference numerals shown in FIG. 9, and the description of which is omitted for the sake of simplicity.

Figure 29:
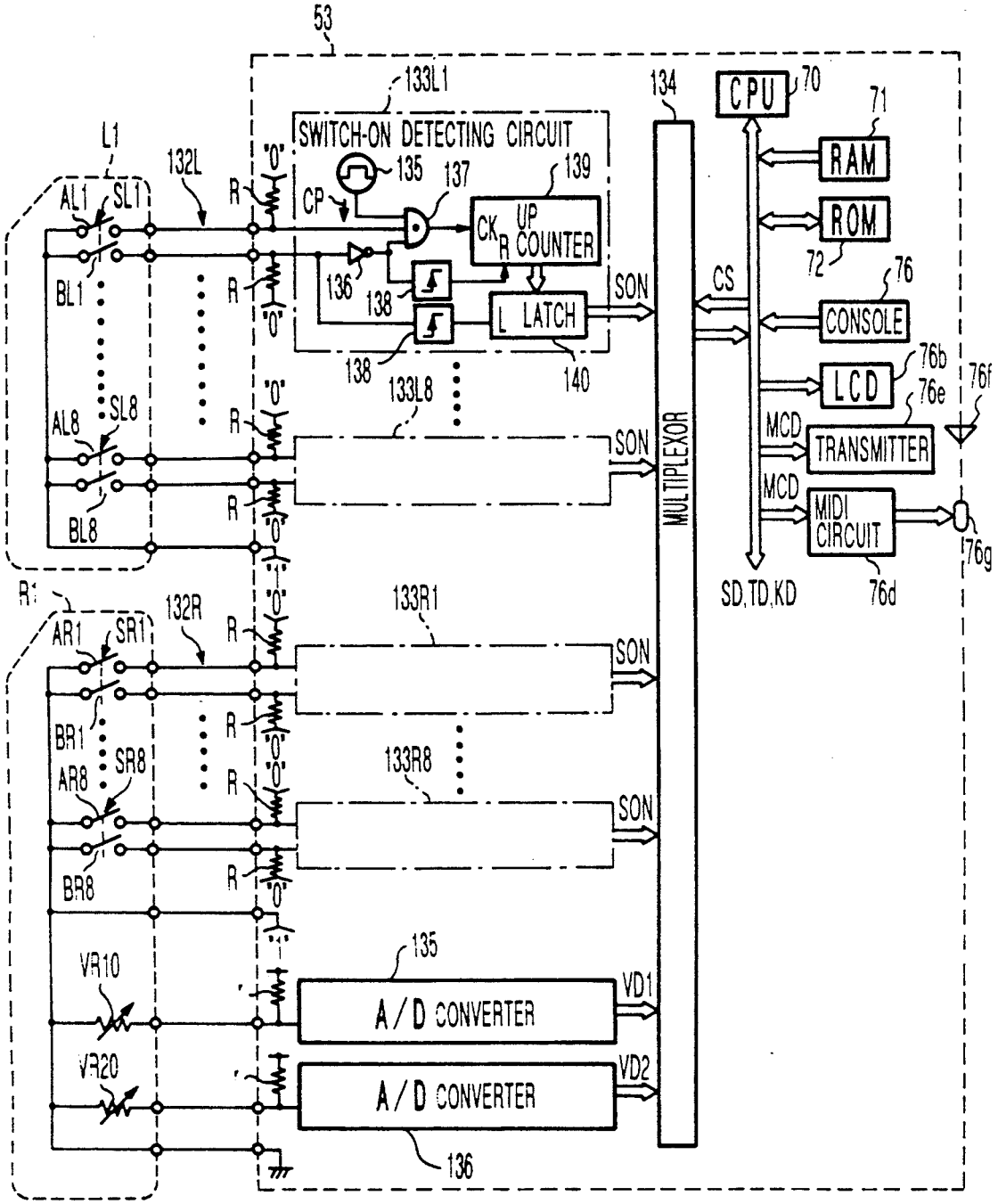
FIG. 29 is a circuit diagram showing the musical tone control apparatus of the second embodiment.

FIG. 29 shows a circuit diagram of the second embodiment. In this drawing, one terminals of push-button switches SL1 to SL8 are connected in common, and connected to a signal source terminal "1" incorporated in controller 53. The other terminals of push-button switches SL1 to SL8 are connected to each signal source terminal "0", and also to each of the switch-on detecting circuits 133L1 to 133L8, respectively.

Each of the switch-on detecting circuits 133L1 to 133L8 generates switch-on data SON based on a signal supplied from each of the push-button switches SL1 to SL8, respectively. Switch-on data SON is therefore output to multiplexer 134 when each of the normally-open switches BL1 to BL8 is closed, in which each of the normally-open switches BL1 to BL8 is incorporated in each of the push-button switches SL1 to SL8.

Each of the switch-on detecting circuits 133L1 to 133L8 comprises a clock oscillator 135, an inverter 136, an AND gate 137, differentiation circuits 138, an up-counter 139, and a latch circuit 140. Accordingly, AND gate 137 receives a clock pulse CP, a signal of normally-open switch AL1 incorporated in push-button switch SL1, and a signal inverted by inverter 136 from normally-open switch BL1. When normally-open switch AL1 is closed, and normally-open switch BL1 is open, AND gate 137 allows a clock pulse CP to output to input terminal CK of up-counter 139. When normally-open switch BL1 is closed, AND gate 137 inhibits a clock pulse CP to output to up-counter 139. When normally-open switch BL1 is closed, differentiation circuit 138 outputs a pulse signal to input terminal L of latch circuit 140. Data incremented by up-counter 139 is thus written into latch circuit 140. The written data is then output to multiplexer 134, as switch-on data SON. Thus, the switch-on data SON corresponds to a speed of depressing respective push-buttons SL1 to SL8, that is, a magnitude of depressing respective push-button switches. When normally-open switch BL1 is open, a signal inverted by inverter 136 is changed to a pulse signal by differentiation circuit 138, the pulse signal then being output to input terminal R of up-counter 139, resetting data in up-counter 139.

Switch-on detecting circuits 133L1 to 133L8 correspond respectively to push-button switches SL1 to SL8 for the left hand. Similarly, switch-on detecting circuits 133R1 to 133R8 are incorporated in controller 53, and correspond respectively to push-button switches SR1 to SR8 for the right hand, and generate switch-on data SON to output to multiplexer 134.

For the right hand, one ends of slide variable resistors VR10 and VR20 are connected in common, and then connected to a ground terminal incorporated in controller 53 through cable 132R. The other ends of slide variable resistors VR10 and VR20 are connected to pull-up resistors "r", and then connected to A-D converters 135 and 136 in controller 53 through cable 132R, respectively.

A-D converters 135 and 136 thus convert detecting voltage signals supplied from slide variable resistors VR10 and VR20 to detecting voltage data VD1 and VD2 to thereby output to multiplexer 134.

Multiplexer 134, in turn, selects from among the switch-on data SON supplied from switch-on detecting circuits 133L1 to 133L8, and detecting voltage data VD1 to VD2 supplied from A-D converters 135 and 136, based on chip-select signals CS which are supplied from CPU 70.

The CPU 70, in turn, supplies chip-select signals CS to multiplexer 134 to scan switch-on data SON output from switch-on detecting circuits 133L1 to 133L8, and detecting voltage data VD1 and VD2 output from A-D converters 135 and 136. CPU 70 then selects from among switch-on data SON, detecting voltage data VD1, and VD2 through multiplexer 134, in turn, and transfer the data to RAM 72. CPU 70 then generates tone pitch data SD for indicating a tone pitch, tone color TD for indicating a tone color, and effect data KD for indicating several effects. Accordingly, each of tone pitch data SD, tone color data TD, and effect data KD is referred to as musical tone control data MCD.

Console 76 generates a code signal converted from a signal output from push-switches **76*a*, and then outputs to CPU 70. CPU 70 transfers musical tone control data MCD to transmitter 76*e* which modulates musical tone control data MCD in accordance to a carrier wave. This modulated signal is transmitted from antenna 76*f*. On the other hand, CPU 70 transfers musical tone control data MCD to MIDI circuit 76*d* to output from terminal 76*g*** to a musical tone generating apparatus.

Figure 30:
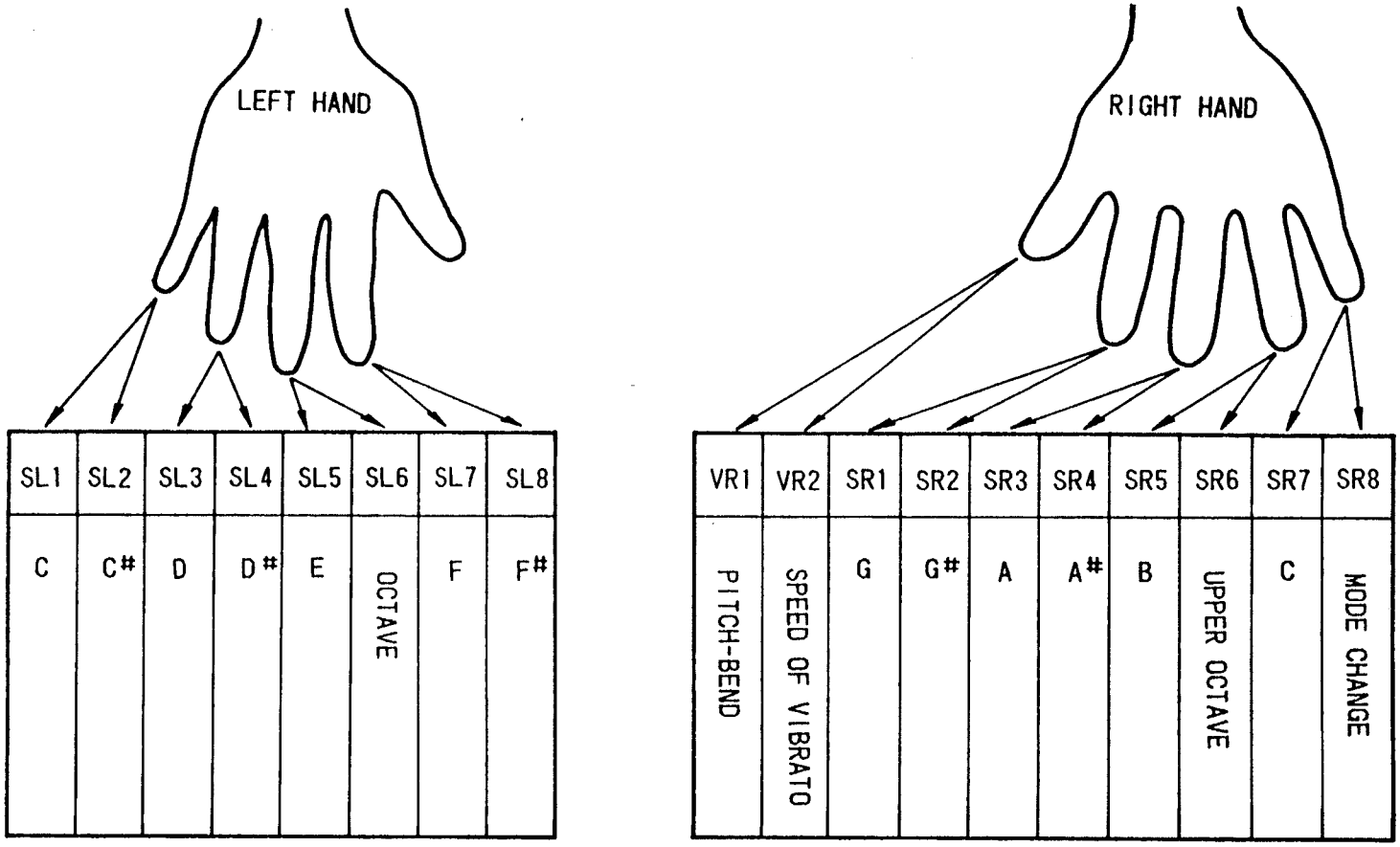
FIG. 30 is a diagram showing function assignments of both grips 1R and 1L.

Operation is described in accordance with the above construction of the musical tone control apparatus. A player attaches controller 53 to his or her waist, and plugs plugs 51R and 51L extending from grips 1R and 1L into sockets 52R and 52L. On the other hand, in the case where the musical tone control apparatus is operated by a wire transmission, terminal **76*g* of MIDI circuit 76*d* is connected to the musical tone generating apparatus by a connecting cable. Switches of power supplies are then turned on, which are incorporated in controller 53 and the musical tone generating apparatus. After turning on the power supply, the type of data transmission is selected to either a wire or a wireless transmission. A function assignment is assigned to a performance corresponding to resistance values of slide variable resistors VR10 and VR20 actuated by push-button switches SR1 to SR8 for the right hand, push-button switches SL1 to SL8 for the left hand, and operating button 9R, as shown in FIG. 30. For example, speeds of pitch-bend and vibrato are assigned to the performance based on output signals of slide variable resistors VR10 and VR20 incorporated in grip 1R**; tone pitches G, G#, A, A#, B, and C are assigned to the performance based on output signals of push-button switches SR1, SR2, SR3, SR4, SR5, and SR7; and upper octaves are assigned to the performance based on output signals of push-button switch SR6, respectively by the right hand. On the other hand, tone pitches C, C#, D, D#, E, F, and F# are assigned to the performance based on output signals of push-button switches SL1, SL2, SL3, SL4, SL5, SL7, and SL8; and lower octaves are assigned to the performance based on output signals of push-button switch SL6, respectively by the left hand. Push-button switch SR8 is used for changing a performance mode, this is not assigned in this case.

The player then holds grip 1R in the right hand, and grip 1L in the left hand. Push-button switch SR8 is depressed by the little finger of the right hand to changed to the tone color selection mode. A tone color is set by depressing one of push-button switches SR1 to SR7, and SL1 to SL8. A given tone color is assigned to each of push-button switches SR1 to SR7 and SL1 to SL8. The player changes to the tone pitch selection mode by depressing push-button switch SR8 by the little finger of the right hand.

The player then depresses a start button to start the performance. Accordingly, CPU 70, in turn, transfers switch-on data SON, and detecting voltage data VD1 and VD2 to RAM 72, then generates musical tone control data MCD which is supplied to MIDI circuit **76*d*. The MIDI circuit 76*d* converts musical tone control data MCD into data indicated by the MIDI standard to supply from terminal 76*g*** to the musical tone generating apparatus through the connecting cable.

Accordingly, a musical tone is generated by musical tone generating apparatus corresponding to data of the MIDI standard to produce it from a speaker. In this case, depressing push-button switch SR3 produces a musical tone having tone pitch A corresponding to magnitude of the press from the musical tone generating apparatus. Under this state, when operating button 9R is moved in the direction of arrow Y1 (referring to FIG. 23) by the thumb of the right hand, a musical tone having tone pitch A is adjusted to a speed of vibrato corresponding to the distance of movement. When operating button 9R is moved in the direction of arrow X1 (referring to FIG. 23) by the thumb of the right hand, a musical tone having tone pitch A is adjusted to a pitch-bend corresponding to the distance of movement. When push-button switch SL6 is then depressed by the middle finger of the left hand, a musical tone having tone pitch A of a lower octave is produced.

In this embodiment, the operating button is mounted on top surface 107, but it can be mounted on side surface 103, and also side surface 105 as well. Furthermore, an operating button can be mounted on grip 1L instead of grip 1R to adjust speed and depth of tremolo in accordance with movement of the slide variable resistors incorporated in grip 1L.

The speed of vibrato is adjusted in accordance with the output of slide variable resistor VR20 in this embodiment, but depth of vibrato, speed of tremolo, depth of tremolo, and the like can be adjusted in accordance with the output thereof.

Each output signal of the slide variable resistors VR10 and VR20 is converted into a digital signal by A-D converters 135 and 136 and supplied to multiplexer 134 in the embodiment, but a digital type volume can be used instead, thus, digital signals can be directly supplied to multiplexer 134.

The preferred embodiment described herein is illustrative and not restrictive; the scope of the invention is indicated by the appended claims and all variations which fall within the claims are intended to be embraced therein.

What is claimed is:

1. A musical tone control apparatus for controlling a musical tone in correspondence with a movement of a part of a performer, comprising:

a holding member adapted to be held by a hand of the performer;

a push-button switch, operable by the performer's hand holding the holding member, for designating generation of a tone, said push-button switch being placed on the holding member;

an actuator including first detecting means for detecting a movement of a performer's operation in an x-axis direction, and second detecting means for detecting movement of a performer's operation in a y-axis direction, said actuator designating a continuously changeable value defining a point on an x-y plane, defined by said x axis and said y-axis, in response to a detected value by said first detecting means, and a detected value by said second detecting means, said actuator being placed on said holding member and being operable by the performer's hand holding the holding member;

conversion means for converting said continuously changeable value into a control signal representing a magnitude of the movement; and control data generating means for generating musical tone control data imparting an effect on the generated musical tone designated by said push button switch in accordance with said control signal.

2. A musical tone control apparatus according to claim 1 in which the holding member includes a grip adapted to be held by a hand and the push-button switch and actuator are arranged on the grip and operated by the fingers.

3. A musical tone control apparatus according to claim 2 in which the conversion means comprises a plurality of rotary type variable resistors which generate a signal corresponding to a movement of the actuator.

4. A musical tone control apparatus according to claim 1 in which the control data generating means has given function assignments which corresponds to each of the fingers, and which supplies musical tone control data supplied from one of the push-button switches and the combination of the rotary type variable resistors.

5. A musical tone control apparatus for controlling a musical tone in correspondence with a movement of a part of a performer, comprising:

a holding member adapted to be held by a hand of the performer including a grip adapted to be held by a hand;

a push-button switch on the grip and operable by the performer's fingers while holding the holding member, for designating generation of a tone, said push-button switch being placed on the holding member;

an actuator mounted on the holding member and operable by the performer's fingers while holding the holding member, for designating a continuously changing value in response to movement thereof;

conversion means for converting said continuously changing value designated by said actuator into a control signal representing a magnitude of the movement, said actuator and said conversion means including:

a rectangular case;

a conversion bar;

two conversion members, each having a hole elongated along a longitudinal direction thereof, both conversion members slidably intersecting each other substantially at right angles with the holes aligned to form a hole into which the conversion bar is inserted, an inserted end of the conversion bar being supported at a pivotal point, and wherein both ends of each of the conversion members are pivotally supported to the rectangular case; and a rotary type variable resistor, mounted on an end of each conversion member, whereby each of the rotary type variable resistors rotates to change resistance value when the conversion bar moves in a predetermined direction; and control data generating means for generating musical tone control data imparting an effect on the generated musical tone designated by said push button switch in accordance with said control signal.

6. A musical tone control apparatus for controlling a musical tone in correspondence with a movement of a part of a performer, comprising:

a holding member adapted to be held by a hand of the performer including a grip adapted to be held by a hand;

a push-button switch on the grip and operable by the performer's fingers while holding the holding member, for designating generation of a tone, said push-button switch being placed on the holding member;

an actuator mounted on the holding member and operable by the performer's fingers while holding the holding member, for designating a continuously changing value in response to movement thereof;

conversion means for converting said continuously changing value designated by said actuator into a control signal representing a magnitude of the movement, wherein said actuator and said conversion means including:

a flexible cover plate;

two slide variable resistors each having a resistor portion and an operating bar, each of the operating bars perpendicularly extending from each of the resistor portions and slidably intersecting each other substantially at right angles so as to be movable along each of the resistor portions;

a slide member mounted on an intersecting portion of the operating bars to slidably guide the operating bars when moving along each of the resistor portions; and an operating button mounted on the slide member so as to be slidably moved on a curved surface under guidance of the flexible cover plate; and control data generating means for generating musical tone control data imparting an effect on the generated musical tone designated by said push button switch in accordance with said control signal.

7. A musical tone control apparatus according to claim 6 in which the function assignment comprises at least one of: a range of octave; a range of pitch-bend; a range of tone volume; a scale including a half tone; a depth of vibrato; a range of tempo; a speed of tremolo; a depth of tremolo; and the like.

8. A musical tone control apparatus comprising:

a case adapted to be gripped by a performer's hand;

a plurality of first operators operated by each finger to generate a first signal representing a generation of a tone, the first operators being mounted on the case;

inputting means, including:

a rectangular type frame incorporated in the case;

at least two transposing portions movably mounted on each of two pairs of opposing inside walls of the frame, in which each of the transposing portions intersect each other;

a second operator mounted on an intersecting portion of the transposing portions, thereby moving one of the transposing portions forward and backward and the other left and right; and at least two rotatively type variable resistors mounted on the inside walls for outputting second signals corresponding to the magnitude of the movements in relation to each of the transposing portions, the rotatively type variable resistors being rotated by each of the transposing portions; and musical tone control data generating means for generating musical control data to control the musical tone generating apparatus based on the first signal output from the first operators and the second signal output from the rotatively type variable resistors.

9. A signal supplying apparatus mounted on a case gripped by a hand, and having a plurality of first operators operated by each finger for supplying signals representing a generation of a tone to an electronic apparatus, the signal supplying apparatus comprising:

a substrate member mounted inside of the case;

at least two slidably variable resistors each having a second operator, each of the second operators being mounted on the substrate member and intersecting each other;

retaining member for retaining the intersecting portion of the second operators with a predetermined margin; and third operator mounted on the retaining member for moving the second operators.

10. A musical tone control apparatus for controlling a musical tone in correspondence with a movement of a part of a performer, comprising:

a holding member adapted to be held by a hand of the performer;

a push-button switch, operable by the performer's hand holding the holding member, for outputting a tone generation signal, said push-button switch being placed on the holding member;

an actuator including first detecting means for detecting a movement of a performer's operation in an x-axis direction, and second detecting means for detecting movement of a performer's operation in a y-axis direction, said actuator designating a continuously changeable value defining a point on an x-y plane, defined by said x axis and said y-axis, in response to a detected value by said first detecting means, and a detected value by said second detecting means, said actuator being placed on said holding member and being operable by the performer's hand holding the holding member; and control data generating means for generating musical tone control data of a musical tone determined based on said tone generation signal and continuously changing signal.

11. A musical tone control apparatus for controlling a musical tone in correspondence with a movement of a part of a performer, comprising:

a holding member adapted to be held by a hand of the performer;

a push-button switch, operable by the performer's hand holding the holding member, for designating generation of a tone, said push-button switch being placed on the holding member;

an actuator, operably by the performer's hand holding the holding member, for designating a continuously changing value in response to movement thereof, said actuator being placed on the holding member;

conversion means for converting said continuously changing value into a control signal representing a magnitude of the movement, said conversion means including a flexible cover plate, two slide variable resistors, each having a resistor portion and an operating bar, each of the operating bars perpendicularly extending from each of the resistor portions and slidably intersecting each other substantially at right angles so as to be movable along each of the resistor portions, a slide member mounted on an intersecting portion of the operating bars to slidably guide the operating bars when moving along each of the resistor portions, both of said operating bars having holes aligned to form a hole into which said slide member is inserted, an inserted end of said slide member being supported at a pivotal point, and wherein both ends of each of the operating bars are pivotally supported to the rectangular case, and an operating button mounted on the slide member so as to be slidably moved on a curved surface under guidance of the flexible cover plate; and control data generating means for generating musical tone control data imparting an effect on the generated musical tone designated by said push button switch in accordance with said control signal.

12. An electronic musical instrument comprising:

(a) detection means, attached to various portions of a human body, for detecting movement of said body portions and for creating an output signal responsive to said movement of said body portions;

(b) control signal generation means responsive to said output signal of said detection means for generating a control signal, wherein said control signal comprises data designating the chord for the accompaniment tone, said data including root data and type data for said chord; and (c) automatic accompaniment means for generating accompaniment tone in response to said control signal.

13. An electronic musical instrument according to claim 12, wherein said control signal comprises data designating the tempo of the accompaniment tone.

14. A musical tone control apparatus for controlling a musical tone in correspondence with a movement of a part of a performer, comprising:

(a) a holding member adapted to be held by a hand of the performer;

(b) plural switches, operable by the performer's hand holding the holding member, for generating first signals indicating an operated switch among said plural switches, said plural switches being placed on the holding member;

(c) angle detector attached to an elbow of the performer for generating second signals corresponding to a bending angle of the elbow; and (d) control means for receiving said first signals and said second signals, and for generating note data representing tone pitch of musical tone to be generated, wherein said second signals define note range and said first signals define each one of said note data in said note range, and generating control signals controlling the generation of musical tone of said note data in response to each operation of said plural switches.

15. A musical tone control apparatus for controlling a musical tone in accordance with a movement of a part of a performer, comprising:

(a) a holding member adapted to be held by a hand of the performer;

(b) plural switches, operable by the performer's hand holding the holding member, for generating a signal indicating an operated switch among said plural switches, said plural switches being placed on the holding member;

(c) an actuator including first detecting means for detecting a movement of a performer's operation in an x-axis direction, and second detecting means for detecting movement of a performer's operation in a y-axis direction, said actuator designating a continuously changeable value defining a point on an x-y plane, defined by said x axis and said y-axis, in response to a detected value by said first detecting means, and detected value by said second detecting means, said actuator being placed on said holding member and being operable by the performer's hand holding the holding member; and (d) control data generating means for generating first control data designating generation of musical tone having a pitch corresponding to each one of said plural switches in response to said signal, and generating second control data based on said continuously changeable value, said second control data controlling pitch bend of said musical tone being generated according to said first control data.

16. A musical tone control apparatus according to claim 15, wherein said second control data of said control data generating means further controls tone color of said musical tone being generated according to said first control data.

17. A musical tone control apparatus for controlling a musical tone in accordance with a movement of a part of a performer, comprising:

(a) a holding member adapted to be held by a hand of the performer;

(b) plural switches, operable by the performer's hand holding the holding member, for generating a signal indicating an operated switch among said plural switches, said plural switches placed on the holding member;

(c) an actuator including first detecting means for detecting a movement of a performer's operation in an x-axis direction, and second detecting means for detecting movement of a performer's operation in a y-axis direction, said actuator designating a continuously changeable value defining a point on an x-y plane, defined by said x axis and said y-axis, in response to a detected value by said first detecting means, and detected value by said second detecting means, said actuator being placed on said holding member and being operable by the performer's hand holding the holding member; and (d) control data generating means for generating first control data designating generation of musical tones having a pitch corresponding to each one of said plural switches in response to said signal, and generating second control data based on said continuously changeable value designated by said actuator, said second control data controlling modulation effect imparted to said musical tone being generated according to said first control data.

18. A musical tone control apparatus according to claim 17, wherein said modulation effect controlled by said second control data is at least one of vibrato and tremolo.

19. A musical tone control apparatus according to claim 18, wherein an element of said modulation effect controlled by said second control data is at least one of speed and depth of said modulation effect.

* * * * *

UNITED STATES PATENT AND TRADEMARK OFFICE

CERTIFICATE OF CORRECTION

PATENT NO. : 5,313,010
DATED : May 17, 1994
INVENTOR(S) : Shunichi Matsushima, et. al.

It is certified that error appears in the above-indentified patent and that said Letters Patent is hereby corrected as shown below:

On the Title page, item [75], inventor: last name should be --Masubuchi--.

Signed and Sealed this

Thirtieth Day of August, 1994

*Attest:*

*Attesting Officer*

Bruce Lehman

BRUCE LEHMAN

*Commissioner of Patents and Trademarks*